US010789875B2

(12) United States Patent
Huang et al.

(10) Patent No.: US 10,789,875 B2
(45) Date of Patent: Sep. 29, 2020

(54) PIXEL MATRIX DISPLAY DEVICE

(71) Applicant: Xianyang Caihong Optoelectronics Technology Co., Ltd, Xianyang (CN)

(72) Inventors: Yusheng Huang, Xianyang (CN); Yuan-Liang Wu, Xianyang (CN); Yuyeh Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 16/291,636

(22) Filed: Mar. 4, 2019

(65) Prior Publication Data

US 2019/0272783 A1 Sep. 5, 2019

(30) Foreign Application Priority Data

Mar. 2, 2018 (CN) ..... 2018 1 0175737
Apr. 25, 2018 (CN) ..... 2018 1 0376086
Jun. 13, 2018 (CN) ..... 2018 1 0606052

(51) Int. Cl.
*G09G 3/20* (2006.01)

(52) U.S. Cl.
CPC ..... *G09G 3/2074* (2013.01); *G09G 3/2003* (2013.01); *G09G 2300/0404* (2013.01); *G09G 2310/027* (2013.01); *G09G 2310/0278* (2013.01); *G09G 2310/08* (2013.01)

(58) Field of Classification Search
CPC ..... G09G 3/2074; G09G 3/2003; G09G 2300/0404; G09G 2310/027; G09G 2310/0278; G09G 2310/08; G09G 2320/0209; G09G 2320/0252; G09G 2320/0271; G09G 2300/0447; G09G 2300/0426; G09G 2300/0452; G09G 3/3648
See application file for complete search history.

(56) References Cited

U.S. PATENT DOCUMENTS

2008/0049047 A1* 2/2008 Credelle ..... G09G 3/2074 345/690
2016/0019825 A1* 1/2016 Guo ..... G09G 3/2003 345/694
2017/0047026 A1* 2/2017 Tsuruma ..... G02F 1/13
2017/0309213 A1* 10/2017 Roh ..... G09G 3/2003

FOREIGN PATENT DOCUMENTS

CN 103163697 6/2013
CN 104347046 2/2015

* cited by examiner

*Primary Examiner* — Andrew Sasinowski
(74) *Attorney, Agent, or Firm* — WPAT, PC

(57) ABSTRACT

The invention provides a pixel matrix display device, which includes a timing controller, a data driving unit, a scan driving unit and a pixel matrix; the pixel matrix includes a plurality of sub-pixels arranged in a matrix; the timing controller is configured to acquire an original signal input data, and convert the original signal input data into a first grayscale data and a second grayscale data; the scan driving unit is configured to load a scan signal to the pixel matrix; and within a frame, the data driving unit is configured to load a first grayscale driving voltage corresponding to the first grayscale data or a second grayscale driving voltage corresponding to the second grayscale data to the pixel matrix along a direction of each data line; wherein, an aspect ratio a/b of the sub-pixel satisfies the relationship: $0.675 \leq a/b \leq 1.48$.

4 Claims, 13 Drawing Sheets

PIXEL MATRIX DISPLAY DEVICE

FIELD OF THE DISCLOSURE

The disclosure relates to an image display technology field, and more particularly to a pixel matrix display device and a pixel matrix display method.

BACKGROUND OF THE DISCLOSURE

In recent years, with the gradual development of LCD (Liquid Crystal Display) technology, UD (4K2K) high-resolution liquid crystal display panels have gradually become popular in the market.

On the one hand, in order to reduce the design cost of UD panels, the pixel design architecture using Dual Gate design is gradually becoming one of the technologies of low-cost UD panel development. However, although Dual Gate design can reduce the number of data on the COF IC (Chip On Flex integrated circuit) to reduce the development cost, there will be problems such as a decrease in panel transmittance and insufficient pixel charging. If it is equipped with GOA (Gate Driver on Array) technology, there may even be problems of insufficient panel driving force, low transmittance, and severe vertical crosstalk, which may affect the display quality and the user viewing experience.

On the other hand, UD panels mostly use 4-Domain low color shift design; however, in the existing 4-Domain VA technology, as the viewing angle is adjusted, the structure of the VA type liquid crystal display panel is prone to color washout at a large viewing angle. The displayed image is easily distorted, especially the performance of the character's skin color tends to be lighter blue or brighter white. Furthermore, as the viewing angle increases (0°, 45°, 60°), the color shift phenomenon becomes more serious. In the 4-Domain arrangement, the polarity of the sub-pixels is affected, which causes crosstalk and abnormal Bright-Dark lines, and poor viewing experience.

On the other hand, various panel makers are now focusing on the development of higher resolution liquid crystal display panels, such as the development of display panels with a resolution of 8K4K. However, as the resolution of the display panel is increased, it is necessary to increase the number of sub-pixels corresponding to the resolution, which increases the design difficulty of the display panel. If the existing design principle is adopted, the designed display panel has low transmittance, severe vertical crosstalk, and insufficient charging during charging to the sub-pixel, which affects the display quality and the user viewing experience.

SUMMARY OF THE DISCLOSURE

In order to solve one or more of the above problems existing in the prior art, the present invention provides a pixel matrix display device.

In a first aspect, an embodiment of the present invention provides a pixel matrix display device including a timing controller, a data driving unit, a scan driving unit, and a pixel matrix; the pixel matrix includes a plurality of pixel units arranged in a predetermined manner; and the timing controller is configured to acquire an original signal input timing, convert the original signal input timing into an aligned signal input timing according to the predetermined regular pixel unit, and within one frame, drive the data driving unit and the scan driving unit to load the corresponding data driving voltage and the scan driving voltage to the pixel matrix according to the arranged signal input timing.

In a specific embodiment, the pixel unit arranged in a predetermined manner includes: a first sub-pixel having a first color filter; a second sub-pixel having a second color filter disposed on a right side of the first sub-pixel; a third sub-pixel having a third color filter disposed under the first sub-pixel; a fourth sub-pixel having a first color filter disposed on a right side of the third sub-pixel; a fifth sub-pixel having a second color filter disposed under the third sub-pixel; and a sixth sub-pixel having a third color filter disposed below the fourth sub-pixel.

In a specific embodiment, the sub-pixel has an aspect ratio (i.e., generally a length-width ratio) of 1.5/2.

In a specific embodiment, the data driving unit and the scan driving unit are configured to: at a first moment, load a corresponding data driving voltage and a scan driving voltage to the first sub-pixel and the second sub-pixel; at a second moment, loading a corresponding data driving voltage and a scan driving voltage to the third sub-pixel and the fourth sub-pixel; and at a third moment, the corresponding data driving voltage and the scan driving voltage are loaded to the fifth sub-pixel and the sixth sub-pixel.

The foregoing pixel matrix display device related to the first aspect embodiment. Through the pixel matrix architecture and driving mode design, the penetration rate is enhanced in the UD panel design, and the pixel charging time is improved, the display quality is enhanced, and the user experience is improved.

In a second aspect, an embodiment of the present invention further provides a low color shift pixel matrix display device, including a timing controller, a data driving unit, a scan driving unit, and a pixel matrix; the pixel matrix includes a plurality of pixel units arranged in a predetermined manner; the timing controller is configured to acquire an original signal input timing, convert the original signal input timing into an aligned signal input timing according to the pixel unit arranged in a predetermined manner, and acquire first grayscale data and second grayscale data according to the arranged signal input timing, and outputting the first grayscale data and the second grayscale data to the data driving unit; the data driving unit is configured to generate a first grayscale driving voltage according to the first grayscale data, generate a second grayscale driving voltage according to the second grayscale data, and load the first grayscale driving voltage or the second grayscale driving voltage to the pixel matrix in a direction of each data line within one frame.

In a specific embodiment, the pixel unit arranged in a predetermined manner includes: a first sub-pixel having a first color filter; a second sub-pixel having a second color filter adjacent to the first sub-pixel in a first direction; a third sub-pixel having a third color filter adjacent to the second sub-pixel in a first direction; a fourth sub-pixel having a third color filter adjacent to the first sub-pixel in a second direction; a fifth sub-pixel having a first color filter adjacent to the fourth sub-pixel in a first direction; a sixth sub-pixel having a second color filter adjacent to the fifth sub-pixel in a first direction; a seventh sub-pixel having a second color filter adjacent to the fourth sub-pixel in a second direction; an eighth sub-pixel having a third color filter adjacent to the seventh sub-pixel in a first direction; and a ninth sub-pixel having a first color filter adjacent to the eighth sub-pixel in the first direction.

In a specific embodiment, the sub-pixel has an aspect ratio of 1.5:2.

In a specific embodiment, the timing controller is specifically configured to acquire original pixel data of each pixel position according to the arranged signal input timing, and convert the original pixel value of each pixel position into the first grayscale data or the second grayscale data according to a predetermined conversion manner.

The low color shift pixel matrix display device of the foregoing embodiment related to the second aspect. Through the pixel matrix architecture and driving mode design, the penetration rate is enhanced in the UD panel design, and the pixel charging time is improved, the display quality is enhanced, and the user experience is improved.

In a third aspect, an embodiment of the present invention provides a pixel matrix display device including a timing controller, a data driving unit, a scan driving unit, and a pixel matrix; the pixel matrix includes a plurality of sub-pixels arranged in a matrix; the timing controller is configured to acquire original signal input data, and convert the original signal input data into first grayscale data and second grayscale data according to the original signal input data; the scan driving unit is configured to load a scan signal to the pixel matrix; and in a frame, the data driving unit is configured to load the first grayscale driving voltage corresponding to the first grayscale data or the second grayscale driving voltage corresponding to the second grayscale data into the pixel matrix along each data line direction; wherein, the sub-pixel aspect ratio a/b satisfies the relationship: 0.675 a/b 1.48.

In a specific embodiment, the sub-pixels have an aspect ratio of 1.5/2 (i.e., 1.5:2) or 2/1.5 (i.e., 2:1.5).

The foregoing pixel matrix display device related to the embodiment of the third aspect. Through the design of the pixel matrix structure and the driving method, in the design of the panel with high resolution requirements such as 8K4K, the coupling effect of the data line on the sub-pixel voltage is greatly reduced, and the aperture ratio is improved, and the transmittance is improved. At the same time, the pixel charging time is improved, the display quality is enhanced, and the user experience is improved.

DETAILED DESCRIPTION OF PREFERRED EMBODIMENTS

The present invention will be further described in detail below in conjunction with the specific embodiments. However, the scope of the above-mentioned subject matter of the present invention should not be construed as being limited to the following embodiments, and the technology implemented based on the present invention is within the scope of the present invention.

Embodiment 1

Figure 1:
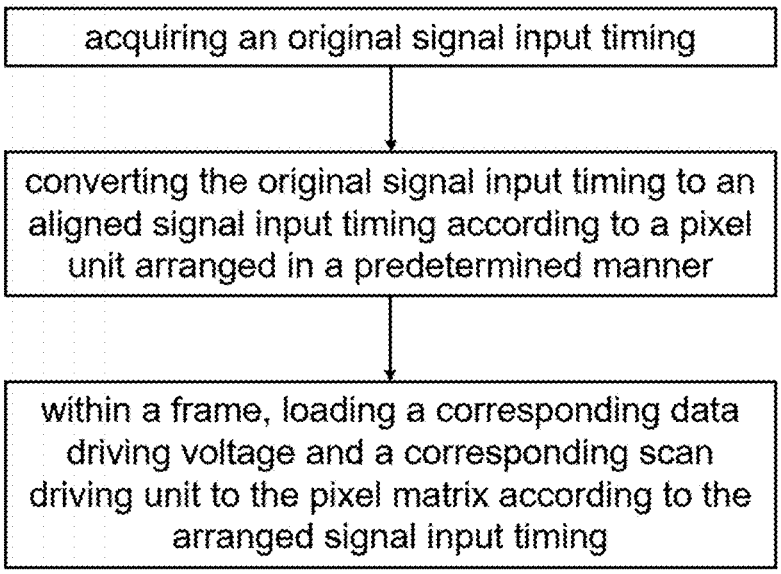
FIG. 1 is a flowchart of a pixel matrix display method according to a first embodiment of the present invention.

Please refer to FIG. 1. FIG. 1 is a flowchart of a pixel matrix display method according to a first embodiment of the present invention, which can be applied to display driving of display panels of various electronic devices.

The pixel matrix in the display panel includes a plurality of pixel units arranged in a predetermined manner, and the pixel matrix display method includes the following steps:

acquiring an original signal input timing;

converting the original signal input timing to an aligned signal input timing according to the pixel unit arranged in a predetermined manner; and within a frame, a corresponding data driving voltage and a scan driving voltage are loaded to the pixel matrix according to the arranged signal input timing.

In a specific embodiment, the pixel unit arranged in a predetermined manner includes: a first sub-pixel having a first color filter; a second sub-pixel having a second color filter disposed on a right side of the first sub-pixel; a third sub-pixel having a third color filter disposed below the first sub-pixel; a fourth sub-pixel having a first color filter disposed on a right side of the third sub-pixel; a fifth sub-pixel having a second color filter disposed below the third sub-pixel; and a sixth sub-pixel having a third color filter disposed below the fourth sub-pixel.

The display method of the embodiment can be applied to displays of various resolution requirements, but is mainly applied to high resolution display; for example, the resolution requirement of the 4K2K display is 3840×2160, that is, the resolution in the X direction is required to be 3840, and the resolution in the Y direction is required to be 2160.

Figure 2:
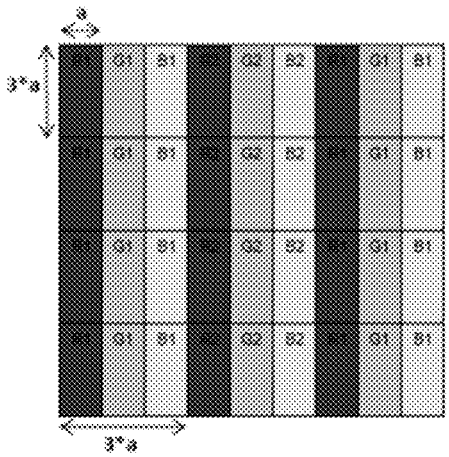
FIG. 2 is a schematic diagram of the ratio and arrangement of existing pixel designs.

Taking the traditional RGB pixel matrix as an example, please refer to FIG. 2. FIG. 2 is a schematic diagram of an existing pixel design ratio and arrangement, a sub-pixel has an aspect ratio of 1:3, and a complete pixel is composed of three sequentially arranged RGB sub-pixels. The pixels are red sub-pixels, green sub-pixels, and blue sub-pixels in the order of the scanning lines and are sequentially cycled. Therefore, in order to achieve the 3840-resolution requirement in the X direction, the number of pixels required is 3840×3, and 2160×1 in the Y direction.

Figure 3:
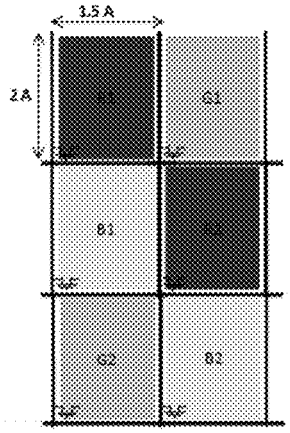
FIG. 3 is a schematic diagram showing the pixel design ratio and arrangement of the first embodiment of the present invention.

For the pixel matrix of the embodiment, please refer to FIG. 3, which is a schematic diagram of the pixel design arrangement of the embodiment. A complete RGB pixel consists of three sub-pixels arranged in a regular arrangement, two R, G sub-pixels in the horizontal direction, and a B sub-pixel in the vertical direction. A complete pixel unit is composed of two RGB pixel combinations, and one pixel unit having 2*3 sub-pixels is composed of two sub-pixels along the scanning line direction and three sub-pixels along the data line direction.

Specifically, an example is described in which the physical positional relationship is represented by up, down, left, and right, and the direction in which the panel is displayed in the forward direction is taken as an example:

The first color filter, the second color filter, and the third color filter are respectively a red filter, a green filter, and a blue filter. The first column along the data line direction is a first sub-pixel, a third sub-pixel, and a fifth sub-pixel, which are respectively a red sub-pixel, a blue sub-pixel, and a green sub-pixel; the second column along the data line direction is a second sub-pixel, a fourth sub-pixel, and a sixth sub-pixel, which are respectively a green sub-pixel, a red sub-pixel, and a blue sub-pixel.

Since the scheme of the present embodiment changes the arrangement structure of the sub-pixels, if the 3840 resolution is required in the X direction, the number of pixels required is 3840×2, and 2160×1.5 in the Y direction. In order to better implement the embodiment, it is necessary to change the driving manner of the pixel matrix and the driving architecture. Therefore, this embodiment uses a pixel sharing method to achieve the same resolution design. In the same 4K2K resolution, the number of pixels in the X direction of the present embodiment is: 3840×2, and the number of pixels in the Y direction is: 2160×1.5, and the design of the present embodiment is completed by using 2 pixels sharing 3 sub-pixels manner in the Y direction.

Correspondingly, in the design of the data line and the scanning line of the panel, there are 7680 sub-pixels along the scanning line direction and 3240 sub-pixels along the data line direction. Therefore, the number of channels required on the Source side (that is, the data driving side) of the present invention is 7680, and the number of channels required on the Gate side (that is, the scan driving side) is 3240. That is to say, 7680 data lines and 3240 scanning lines are required, and the COF of the corresponding Source side is 6 and the COF of the Gate side is 6.

In a specific embodiment, the sub-pixels have an aspect ratio of 1.5:2. Specifically, if the conventional sub-pixel has a length of a, and a width of 3a, the sub-pixel of the embodiment has a length of 1.5a and a width of 2a.

In a specific embodiment, the step of loading the corresponding data driving voltage and the scan driving voltage to the pixel matrix according to the arranged signal input timing includes:

loading a corresponding data driving voltage and the scan driving voltage to the first sub-pixel and the second sub-pixel at a first moment;

loading the corresponding data driving voltage and the scan driving voltage to the third sub-pixel and the fourth sub-pixel at a second moment; and loading the corresponding data driving voltage and the scan driving voltage to the fifth sub-pixel and the sixth sub-pixel at a third moment.

Figure 4:
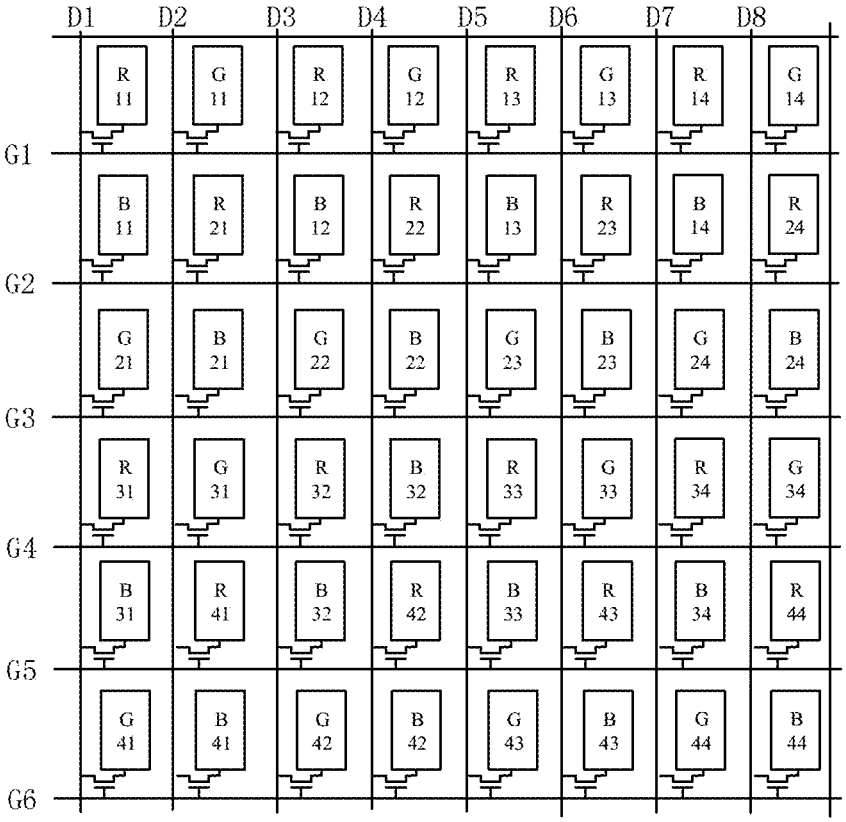
FIG. 4 is a schematic diagram of a pixel matrix structure according to a first embodiment of the present invention.

For a better description of the driving architecture and the driving manner of the embodiment, please refer to FIG. 4, which is a schematic diagram of a pixel matrix structure provided by the embodiment. R11, G11, R12, G12, R13, G13, R14, and G14 are eight adjacent sub-pixels in the first row, and R11, B11, G21, R31, B31, and G41 are six sub-pixels adjacent to the first column. where R represents a red sub-pixel, G represents a green sub-pixel, and B represents a blue sub-pixel, a complete pixel consists of 3 sub-pixels, such as R11, G11, B11, to display a complete pixel in an image. One pixel unit is 6 sub-pixels, for example, R11, G11, G11, R21, G21, B21, a total of 6 sub-pixels constitute one pixel unit, or R12, G12, B12, R22, G22, B22, a total of 6 sub-pixels constitute one pixel unit.

Wherein the data line D1 is connected to the sub-pixel R11, the sub-pixel B11, the sub-pixel G21, the sub-pixel R31, the sub-pixel B31, and the sub-pixel G41, the data line D2 is connected to the sub-pixel G11, the sub-pixel R21, the sub-pixel B21, the sub-pixel G31, the sub-pixel R41, and the sub-pixel B41, the data line D3 is connected to the sub-pixel R12, the sub-pixel B12, the sub-pixel G22, the sub-pixel R32, the sub-pixel B32, and the sub-pixel G42, the data line D4 is connected to the sub-pixel G12, the sub-pixel R22, the sub-pixel B22, the sub-pixel B32, the sub-pixel R42, and the sub-pixel B42, the data line D5 is connected to the sub-pixel R13, the sub-pixel B13, the sub-pixel G23, the sub-pixel R33, the sub-pixel B33, and the sub-pixel G43, the data line D6 is connected to the sub-pixel G13, the sub-pixel R23, the sub-pixel B23, the sub-pixel G33, the sub-pixel R43, and the sub-pixel B43, the data line D7 is connected to the sub-pixel R14, the sub-pixel B14, the sub-pixel G24, the sub-pixel R34, the sub-pixel B34, the sub-pixel G44, and the data line D8 is connected to the sub-pixel G14, the sub-pixel R24, the sub-pixel B24, the sub-pixel B34, the sub-pixel R44, and the sub-pixel B44; and so on.

The scanning line G1 is connected to the sub-pixel R11, the sub-pixel G11, the sub-pixel R12, the sub-pixel G12, the sub-pixel R13, the sub-pixel G13, the sub-pixel R14, and the sub-pixel G14, the scanning line G2 is connected to the sub-pixel B11, the sub-pixel R21, the sub-pixel B12, the sub-pixel R22, the sub-pixel B13, the sub-pixel R23, the sub-pixel B14, and the sub-pixel R24, the scanning line G3 is connected to the sub-pixel G21, the sub-pixel B21, the sub-pixel G22, the sub-pixel B22, the sub-pixel G23, the sub-pixel B23, the sub-pixel G24, and the sub-pixel B24, the scanning line G4 is connected to the sub-pixel R31, the sub-pixel G31, the sub-pixel R32, the sub-pixel G32, the sub-pixel R33, the sub-pixel G33, the sub-pixel R34, and the sub-pixel G34, the scanning line G5 is connected to the sub-pixel B31, the sub-pixel R41, the sub-pixel B32, the sub-pixel R42, the sub-pixel B33, the sub-pixel R43, the sub-pixel B34, the sub-pixel R44, and the scanning line G6 is connected to the sub-pixel G41, the sub-pixel B41, the sub-pixel G42, the sub-pixel B42, the sub-pixel G43, the sub-pixel B43, the sub-pixel G44, and the sub-pixel B44; and so on.

In the driving sequence, at the first moment of a certain frame, the scanning line G1 is turned on, the data line D1, the data line D2, the data line D3, the data line D4, the data line D5, the data line D6, the data line D7, the data line D8 respectively charge the sub-pixel R11, the sub-pixel G11, the sub-pixel R12, the sub-pixel G12, the sub-pixel R13, the sub-pixel G13, the sub-pixel R14, the sub-pixel G14 with a voltage;

at the second moment of the frame, the scanning line G2 is turned on, the data line D1, the data line D2, the data line D3, the data line D4, the data line D5, the data line D6, the data line D7, the data line D8 respectively charge the sub-pixel B11, the sub-pixel R21, the sub-pixel B12, the sub-pixel R22, the sub-pixel B13, the sub-pixel R23, the sub-pixel B14, and the sub-pixel R24 with a voltage;

at the third moment of the frame, the scanning line G3 is turned on, the data line D1, the data line D2, the data line D3, the data line D4, the data line D5, the data line D6, the data line D7, the data line D8 respectively charge the sub-pixel G21, the sub-pixel B21, the sub-pixel G22, the sub-pixel B22, the sub-pixel G23, the sub-pixel B23, the sub-pixel G24, and the sub-pixel B24 with a voltage;

at the fourth moment of the frame, the scanning line G4 is turned on, the data line D1, the data line D2, the data line D3, the data line D4, the data line D5, the data line D6, the data line D7, and the data line D8 respectively charge the sub-pixel R31, the sub-pixel G31, the sub-pixel R32, the sub-pixel G32, the sub-pixel R33, the sub-pixel G33, the sub-pixel R34, and the sub-pixel G34 with a voltage;

at the fifth moment of the frame, the scanning line G5 is turned on, the data line D1, the data line D2, the data line D3, the data line D4, the data line D5, the data line D6, the data line D7, and the data line D8 respectively charge the sub-pixel B31, the sub-pixel R41, the sub-pixel B32, the sub-pixel R42, the sub-pixel B33, the sub-pixel R43, the sub-pixel B34, and the sub-pixel R44 with a voltage; and at the sixth moment of the frame, the scanning line G6 is turned on, the data line D1, the data line D2, the data line D3, the data line D4, the data line D5, the data line D6, the data line D7, and the data line D8 are charged with voltages to the sub-pixel G41, the sub-pixel B41, the sub-pixel G42, the sub-pixel B42, the sub-pixel G43, the sub-pixel B43, the sub-pixel G44, and the sub-pixel B44, respectively. After the completion of one frame, the next frame sub-pixel charging is continued according to the above principle.

According to the above, in the conventional Normal Gate design, the number of pixels in the Y direction is 2160×1=2160, and the number of scanning lines corresponds to 2160 pixels in the Y direction. Taking the scanning frequency of 60 Hz as an example, the corresponding charging time of each sub-pixel is about 7.7 μs.

In the existing Dual Gate design, the number of pixels in the Y direction is 2160×1=2160, and the number of scanning lines corresponds to the number of pixels in the Y direction is 2160×2=4320. Taking the scanning frequency of 60 Hz as an example, the charging time of each corresponding sub-pixel is about 3.86 μs.

For the design of this embodiment, please refer to Table 1. The number of pixels in the Y direction is 2160×1.5=3240, and according to the architecture of the embodiment, the number of scanning lines is 3240. Since the total scan time of one frame is fixed, the corresponding scan time, the corresponding charging time of each sub-pixel is about 5.14 μs.

It can be seen that in the Dual Gate design, although the design cost is reduced, the charging time of the sub-pixel is also greatly reduced. The sub-pixel charging time of the Dual Gate is only half of that of the conventional Normal Gate design, so it is easy to cause the problem of insufficient charging. However, although the architecture of the present invention increases the pixel in the Y direction to 3240, the charging time of the sub-pixel still has 66.6% of the traditional Normal Gate design. In addition, if the UD panel adopts the Dual Gate design, it will have a 20% transmittance loss compared to the conventional design, and the pixel transmittance of the present invention will not be lost, and the display quality can be improved.

In summary, the pixel matrix display method of the embodiment. Through the pixel matrix architecture and driving method design, the penetration rate is enhanced in the UD panel design, and the pixel charging time is improved, the display quality is enhanced, and the user experience is improved.

Embodiment 2

Figure 5:
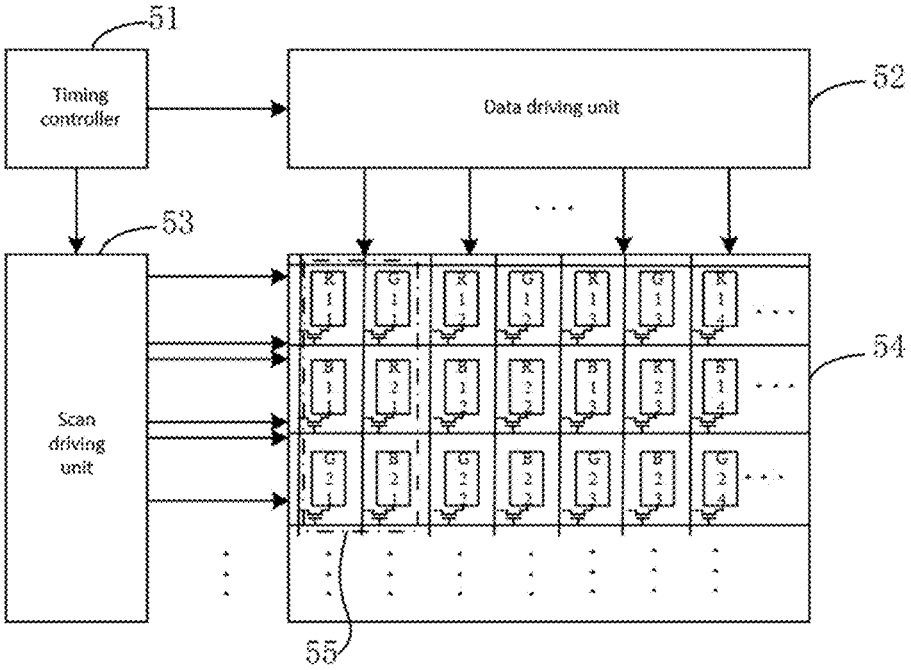
FIG. 5 is a schematic diagram of a pixel matrix display device according to a second embodiment of the present invention.

FIG. 5 is a schematic diagram of a pixel matrix display device according to a second embodiment of the present invention, including a timing controller 51, a data driving unit 52, a scan driving unit 53, and a pixel matrix 54.

The pixel matrix 55 includes a plurality of pixel units 55 arranged in a predetermined regular manner; the timing controller 51 is configured to acquire an original signal input timing, and convert the original signal input timing into an aligned signal input timing according to the pixel unit 55 arranged in a predetermined manner. And, within one frame, the data driving unit 52 and the scan driving unit 53 are driven to load the corresponding data driving voltage and scan driving voltage to the pixel matrix 54 according to the arranged signal input timing.

In a specific embodiment, the pixel unit 55 arranged in a predetermined manner includes: a first sub-pixel having a first color filter; a second sub-pixel having a second color filter disposed on a right side of the first sub-pixel; a third sub-pixel having a third color filter disposed under the first sub-pixel; a fourth sub-pixel having a first color filter disposed on a right side of the third sub-pixel; a fifth sub-pixel having a second color filter disposed under the third sub-pixel; and a sixth sub-pixel having a third color filter disposed below the fourth sub-pixel.

In a specific embodiment, the sub-pixel has an aspect ratio of 1.5:2.

In a specific embodiment, the data driving unit 52 and the scan driving unit 53 are configured to: at a first moment, load a corresponding data driving voltage and a scan driving voltage to the first sub-pixel and the second sub-pixel; at a second time, loading a corresponding data driving voltage and a scan driving voltage to the third sub-pixel and the fourth sub-pixel; and at a third time, loading the corresponding data driving voltage and the scan driving voltage to the fifth sub-pixel and the sixth sub-pixel.

Embodiment 3

Figure 6:
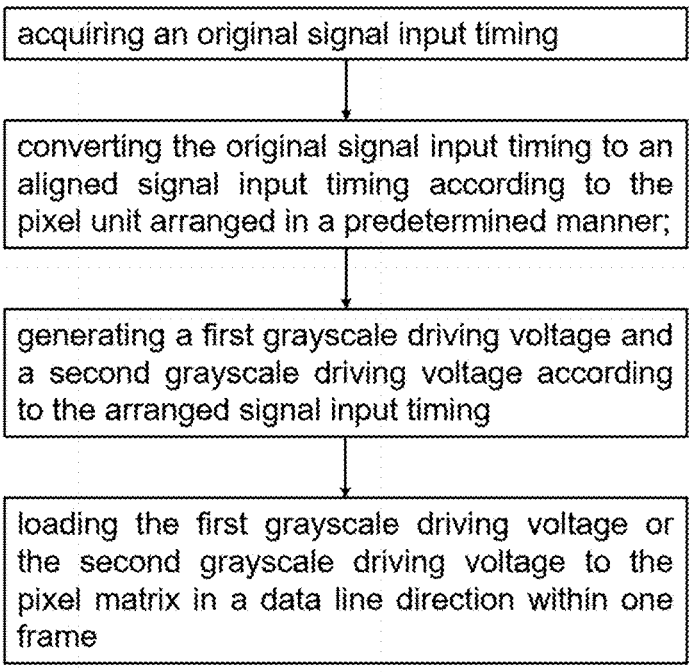
FIG. 6 is a flowchart of a method for displaying a low color shift pixel matrix according to a third embodiment of the present invention.

Referring to FIG. 6, FIG. 6 is a flowchart of a method for displaying a low color shift pixel matrix according to a third embodiment of the present invention, which is suitable for display driving of a display panel of different display devices.

The pixel matrix in the display panel includes a plurality of pixel units arranged in a predetermined manner, and the low color shift pixel matrix display method includes the following steps:

acquiring the original signal input timing;

converting the original signal input timing to an aligned signal input timing according to the pixel unit arranged in a predetermined manner;

generating a first grayscale driving voltage and a second grayscale driving voltage according to the arranged signal input timing; and loading the first grayscale driving voltage or the second grayscale driving voltage to the pixel matrix in a data line direction within one frame.

In a specific embodiment, the pixel unit arranged in a predetermined manner includes: a first sub-pixel having a first color filter; a second sub-pixel having a second color filter adjacent to the first sub-pixel in a first direction; a third sub-pixel having a third color filter adjacent to the second sub-pixel in a first direction; a fourth sub-pixel having a third color filter adjacent to the first sub-pixel in a second direction; a fifth sub-pixel having a first color filter adjacent to the fourth sub-pixel in a first direction; a sixth sub-pixel having a second color filter adjacent to the fifth sub-pixel in a first direction; a seventh sub-pixel having a second color filter adjacent to the fourth sub-pixel in a second direction; an eighth sub-pixel having a third color filter adjacent to the seventh sub-pixel in a first direction; and a ninth sub-pixel having a first color filter adjacent to the eighth sub-pixel in the first direction.

The display method of the present embodiment can be applied to display devices of various resolution requirements, but is mainly applied to high resolution display. For example, the resolution requirement of the 4K2K display device is 3840×2160, that is, the resolution requirement in the X direction is 3840, and the resolution requirement in the Y direction is 2160.

Figure 7:
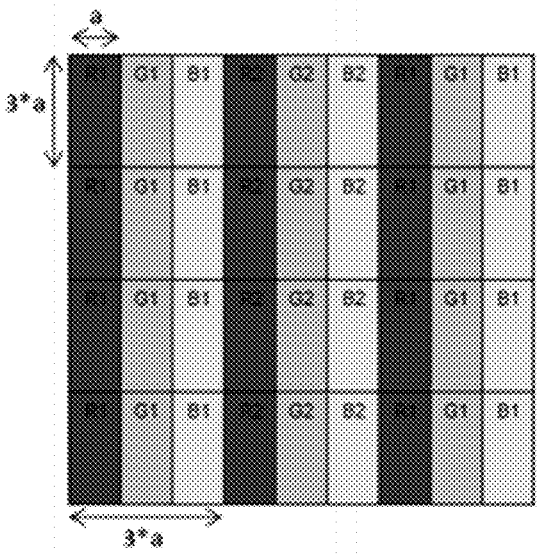
FIG. 7 is a schematic diagram of a conventional pixel design ratio and arrangement.

Taking the traditional RGB pixel matrix as an example, please refer to FIG. 7. FIG. 7 is a schematic diagram of the ratio and arrangement of existing pixel designs. A sub-pixel has an aspect ratio of 1:3, and a complete pixel consists of three sequentially arranged RGB sub-pixels. The pixels are red sub-pixels, green sub-pixels, and blue sub-pixels in the order of the scanning lines and are sequentially cycled. Therefore, in order to achieve the 3840-resolution requirement in the X direction, the number of pixels required is 3840×3, and 2160×1 in the Y direction.

For the pixel matrix of the embodiment, a complete RGB pixel is composed of three sub-pixels arranged in a regular manner. For example, three R, G, B sub-pixels in the horizontal direction or three B, R, G sub-pixels in the horizontal direction or three G, B, and R sub-pixels in the horizontal direction. A complete pixel unit is a matrix formed by three sub-pixels along the data line direction and three sub-pixels along the scanning line direction to form a 3*3 pixel unit. For example, the three sub-pixels of the first row are sequentially RGB, the three sub-pixels of the second row are BRG, and the three sub-pixels of the third row are GBR. Wherein the first direction is along the scanning line direction, and the second direction is along the data line direction.

Specifically, an example is described in which the physical positional relationship is represented by up, down, left, and right, and the direction in which the panel is displayed in the forward direction is taken as an example.

The first color filter, the second color filter, and the third color filter are respectively a red filter, a green filter, and a blue filter. The first column along the data line direction is a first sub-pixel, a fourth sub-pixel, and a seventh sub-pixel, which are respectively a red sub-pixel, a blue sub-pixel, and a green sub-pixel. The second column along the direction of the data line is a second sub-pixel, a fifth sub-pixel, and an eighth sub-pixel, which are respectively a green sub-pixel, a red sub-pixel, and a blue sub-pixel. The third column along the data line direction is a third sub-pixel, a sixth sub-pixel, and a ninth sub-pixel, which are respectively a blue sub-pixel, a green sub-pixel, and a red sub-pixel. Certainly, the specific sub-pixel colors of different columns are correspondingly transformed, and the specific transformation manner is determined according to the manner of the embodiment.

Since the scheme of the present embodiment changes the arrangement structure of the sub-pixels, if the 3840 resolution is required in the X direction, the number of pixels required is 3840×2, and 2160×1.5 in the Y direction. In order to better implement the embodiment, it is necessary to change the driving manner of the pixel matrix and the driving architecture. Therefore, this embodiment uses a pixel sharing method to achieve the same resolution design. In the same 4K2K resolution, the number of pixels in the X direction of the present embodiment is: 3840×2, and the number of pixels in the Y direction is: 2160×1.5, and the design of the present embodiment is completed by using 2 pixels sharing 3 sub-pixels manner in the Y direction.

Correspondingly, in the design of the data line and the scanning line of the panel, there are 7680 sub-pixels along the scanning line direction and 3240 sub-pixels along the data line direction. Therefore, the number of channels required on the Source side of the present invention is 7680, and the number of channels required on the Gate side is 3240. That is to say, 7680 data lines and 3240 scanning lines are required, and the COF of the corresponding Source side is 6 and the COF of the Gate side is 6.

In a specific embodiment, the sub-pixels have an aspect ratio of 1.5:2. Specifically, if the conventional sub-pixel has a length of a, and a width of 3a, the sub-pixel of the embodiment has a length of 1.5a and a width of 2a.

Figure 8:
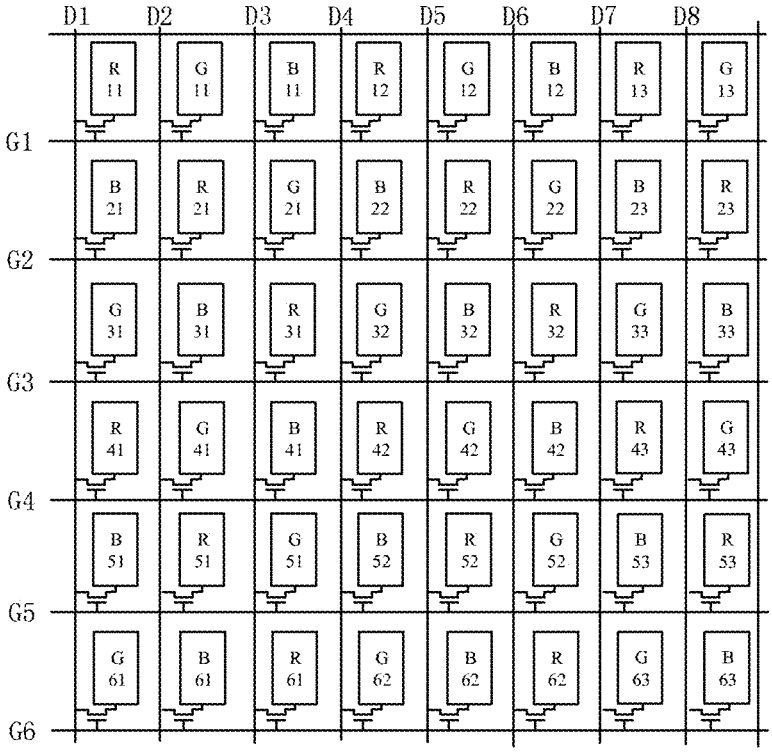
FIG. 8 is a schematic diagram of a low color shift pixel matrix structure according to a third embodiment of the present invention.

For a better description of the driving architecture and the driving manner of the embodiment, please refer to FIG. 8. FIG. 8 is a schematic diagram of a low color-off pixel matrix structure provided by the embodiment. R11, G11, B11, R12, G12, B12, R13, and G13 are eight adjacent sub-pixels in the first row, and R11, B21, G31, R41, B51, and G61 are six adjacent sub-pixels in the first column. Where R represents a red sub-pixel, G represents a green sub-pixel, and B represents a blue sub-pixel, wherein a complete pixel is composed of 3 sub-pixels, such as R11, G11, B21, to display a complete pixel in an image. And a pixel unit is 9 sub-pixels, for example, the three sub-pixels R11, G11, and B11 of the first row, and the three sub-pixels B21, R21, and G21 of the second row, and the sub-pixels G31, B31, and R31 of the third row collectively constitute one pixel unit.

Wherein the data line D1 is connected to the sub-pixel R11, the sub-pixel B21, the sub-pixel G31, the sub-pixel R41, the sub-pixel B51, and the sub-pixel G61, the data line D2 is connected to the sub-pixel G11, the sub-pixel R21, the sub-pixel B31, the sub-pixel G41, the sub-pixel R51, and the sub-pixel B61, the data line D3 is connected to the sub-pixel B11, the sub-pixel G21, the sub-pixel R31, the sub-pixel B41, the sub-pixel G51, and the sub-pixel R61; and so on.

The scanning line G1 connects the sub-pixel R11, the sub-pixel G11, the sub-pixel B11, the sub-pixel R12, the sub-pixel G12, the sub-pixel B12, the sub-pixel R13, and the sub-pixel G13, the scanning line G2 connects the sub-pixel B21, the sub-pixel R21, the sub-pixel G21, the sub-pixel B22, the sub-pixel R22, the sub-pixel G22, the sub-pixel B23, and the sub-pixel R23, the scanning line G3 connects the sub-pixel G31, the sub-pixel B31, the sub-pixel R31, the sub-pixel G32, the sub-pixel B32, the sub-pixel R32, the sub-pixel G33, and the sub-pixel B33; and so on.

In the driving sequence, at the first moment of a certain frame, the scanning line G1 is turned on, the data line D1, the data line D2, the data line D3, the data line D4, the data line D5, the data line D6, the data line D7, and the data line D8 respectively charge the sub-pixel R11, the sub-pixel G11, the sub-pixel B11, the sub-pixel R12, the sub-pixel G12, the sub-pixel B12, the sub-pixel R13, and the sub-pixel G13 with a voltage;

at the second moment of the frame, the scanning line G2 is turned on, the data line D1, the data line D2, the data line D3, the data line D4, the data line D5, the data line D6, the data line D7, and the data line D8 respectively charge the sub-pixel B21, the sub-pixel R21, the sub-pixel G12, the sub-pixel B22, the sub-pixel R22, the sub-pixel G22, the sub-pixel B23, and the sub-pixel R23 with a voltage;

at the third moment of the frame, the scanning line G3 is turned on, the data line D1, the data line D2, the data line D3, the data line D4, the data line D5, the data line D6, the data line D7, and the data line D8 are respectively charged with voltages to the sub-pixel G31, the sub-pixel B31, the sub-pixel R31, the sub-pixel G32, the sub-pixel B32, the sub-pixel R32, the sub-pixel G33, and the sub-pixel B33;

at the fourth moment of the frame, the scanning line G4 is turned on, the data line D1, the data line D2, the data line D3, the data line D4, the data line D5, the data line D6, the data line D7, and the data line D8 are respectively charged with voltages to the sub-pixel R41, the sub-pixel G41, the sub-pixel B41, the sub-pixel R42, the sub-pixel G42, the sub-pixel B42, the sub-pixel R43, and the sub-pixel G43;

at the fifth moment of the frame, the scanning line G5 is turned on, the data line D1, the data line D2, the data line D3, the data line D4, the data line D5, the data line D6, the data line D7, and the data line D8 respectively charge the sub-pixel B51, the sub-pixel R51, the sub-pixel G51, the sub-pixel B52, the sub-pixel R52, the sub-pixel G52, the sub-pixel B53, and the sub-pixel R53 with a voltage; and at the sixth moment of the frame, the scanning line G6 is turned on, the data line D1, the data line D2, the data line D3, the data line D4, the data line D5, the data line D6, the data line D7, and the data line D8 are respectively charged with voltages to the sub-pixel G61, the sub-pixel B61, the sub-pixel R61, the sub-pixel G62, the sub-pixel B62, the sub-pixel R62, the sub-pixel G63, and the sub-pixel B63. After the completion of one frame, the next frame sub-pixel charging is continued according to the above principle.

According to the above, in the conventional Normal Gate design, the number of pixels in the Y direction is 2160×1=2160, and the number of scanning lines corresponds to 2160 pixels in the Y direction. Taking the scanning frequency as 60 Hz as an example, the corresponding charging time of each sub-pixel is 7.7 μs.

In the existing Dual Gate design, the number of pixels in the Y direction is 2160×1=2160, and the number of scanning lines corresponds to the number of pixels in the Y direction is 2160×2=4320. Taking the scanning frequency as 60 Hz as an example, the corresponding charging time of each sub-pixel is 3.86 μs.

For the design of this embodiment, please refer to Table 1. The number of pixels in the Y direction is 2160×1.5=3240, and according to the architecture of the embodiment, the number of scanning lines is 3240. Since the total scan time of one frame is fixed, the corresponding scan time, the corresponding charging time of each sub-pixel is 5.14 μs.

As can be seen from the above, in the Dual Gate design, although the design cost is reduced, the charging time of the sub-pixel is also greatly reduced. The sub-pixel charging time of the Dual Gate is only half of that of the conventional Normal Gate design, so it is easy to cause the problem of insufficient charging. However, although the architecture of the present invention increases the pixel in the Y direction to 3240, the charging time of the sub-pixel still has 66.6% of the traditional Normal Gate design. In addition, if the UD panel adopts the Dual Gate design, it will have a 20% transmittance loss compared to the conventional design, and the pixel transmittance of the present invention will not be lost, and the display quality can be improved.

In summary, the low color shift pixel matrix display method of the embodiment. Through the pixel matrix architecture with the driving method design, the penetration rate is enhanced in the UD panel design, and the pixel charging time is improved, the display quality is enhanced, and the user experience is improved.

In a specific embodiment, the foregoing generating the first grayscale driving voltage and the second grayscale driving voltage according to the arranged signal input timing, including:

acquiring original pixel data of each pixel position according to the arranged signal input timing, converting original pixel data of each pixel position into the first grayscale data or the second grayscale data according to a predetermined conversion manner; in a specific example, the first grayscale data is, for example, high grayscale data, and the second grayscale data is, for example, low grayscale data. Correspondingly, the magnitude of the voltage input to the sub-pixel is determined by the grayscale, and the high grayscale voltage corresponding to the high grayscale data is generated, that is, the first grayscale driving voltage; a low grayscale voltage corresponding to the low grayscale data, that is, a second grayscale driving voltage. It is worth mentioning that the above-mentioned high grayscale and low grayscale represent the relative values of the grayscale sizes of the two groups, and the magnitude of the values is not separately limited.

Here, by processing the original pixel data, further first grayscale data and second grayscale data are acquired, and the first grayscale data is different from the grayscale of the second grayscale data and is further loaded to the corresponding subpixels at different arrangement intervals between different pixels or different frames. The solution of this embodiment can generate two sets of different grayscale, corresponding to different sub-pixels, respectively. In this way, it is possible to prevent the voltage applied to the sub-pixel from being affected by the polarity inversion, thereby avoiding the occurrence of crosstalk and bright and dark lines.

In the above, after the grayscale corresponding to each pixel position is determined according to the rule of the embodiment, the timing controller adjusts the original grayscale correspondence of the pixel position to a high grayscale or a low grayscale, and the adjusted grayscale data (grayscale value) is sent to the data driving unit, and the number driving unit outputs the corresponding grayscale driving voltage according to the grayscale data.

For example, the original pixel data of the A position is a 128 grayscale, and according to the above rule of the embodiment, the A position should output a high grayscale, that is, H. After calculation, in this example, H=138 grayscale, then output the 138 grayscale to the A position, the data driving unit receives the 138 grayscale, according to the predetermined conversion rule, the voltage corresponding to the grayscale of 138 is 10V, and finally the voltage signal of 10V is output to the A position. Generally, the adjustment range of the high and low grayscale is determined by the difference of materials such as liquid crystal.

For another example, the original pixel data of the B position is a 128 grayscale. According to the above rule according to the embodiment, the B position should output a low grayscale, that is, L. After calculation, in this example, L=118 grayscale, then output the 118 grayscale to the B position, the data driving unit receives the 118 grayscale. According to the established conversion rules, the voltage corresponding to the grayscale of 118 is 8V, and finally the voltage signal of 8V is output to the B position.

Figure 9:
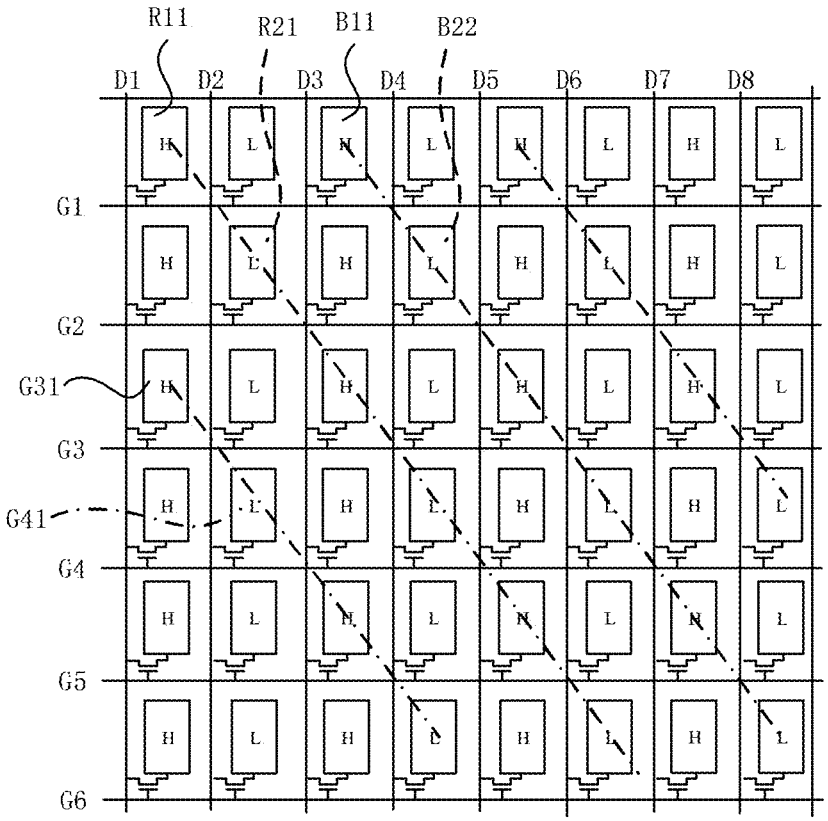
FIG. 9 is a schematic diagram of a grayscale matching of a low color shift pixel matrix according to a third embodiment of the present invention.

Referring to FIG. 9, FIG. 9 is a schematic diagram of a grayscale matching of a low color shift pixel matrix according to a third embodiment of the present invention. For a column along the direction of the data line, the grayscale of each sub-pixel is H or both, and for a row along the direction of the scanning line, H and L are alternated; it should be noted that, in the prior art, the H/L of the same color layer is generally designed to the adjacent left and right positions or the upper and lower positions, and the embodiment is disposed at diagonally adjacent diagonal positions (Refer to FIGS. 8 and 9 together). That is, if R11 is currently H, the sub-pixel of L corresponding to R11 is R21, and so on. The dotted line in FIG. 9 indicates the grayscale matching direction of this embodiment.

In a specific implementation, the original pixel data of each pixel position is acquired according to the signal input timing of the arrangement, converting original pixel data of each pixel position into the first grayscale data or the second grayscale data according to a predetermined conversion manner. Specifically, the timing controller uses a sub-pixel whose coordinate position is P(i, j) and a sub-pixel whose coordinate position is P(i+1, j+1) as a pixel of the same color layer. The original pixel data corresponding to the P(i,j) sub-pixel is converted into high grayscale data, and the original pixel data corresponding to the P(i+1, j+1) sub-pixel is converted into low-gray data to implement H/L matching.

For the sub-pixel design method of the implementation architecture, the oblique H/L matching can better improve the side visibility, so that the pixels in the pixel matrix are not affected by the polarity, and the problems such as crosstalk, bright and dark lines are improved, and the display quality is improved.

Embodiment 4

Figure 10:
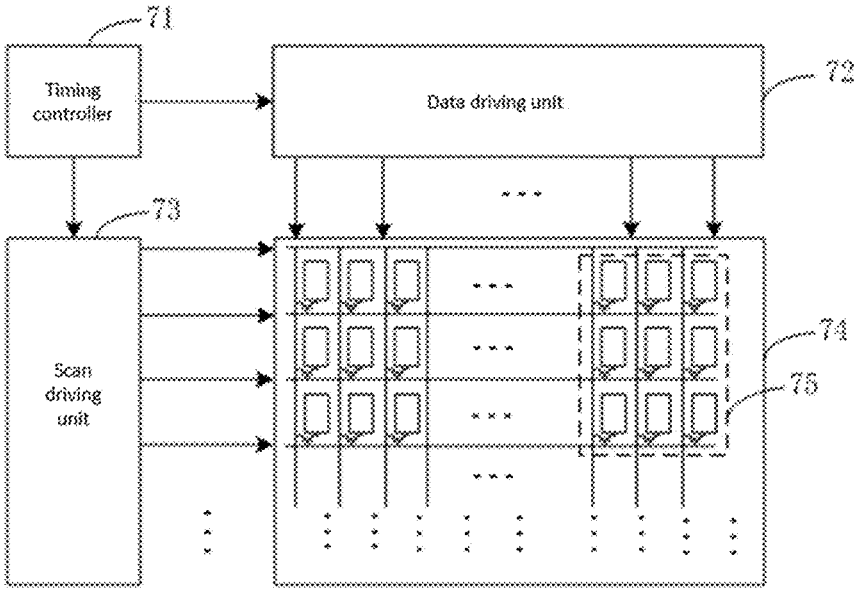
FIG. 10 is a schematic diagram of a low color shift pixel matrix display device according to a fourth embodiment of the present invention.

FIG. 10 is a schematic diagram of a low color shift pixel matrix display device according to a fourth embodiment of the present invention, including a timing controller 71, a data driving unit 72, a scan driving unit 73, and a pixel matrix 74.

The pixel matrix 74 includes a plurality of pixel units 75 arranged in a predetermined regular manner;

the timing controller 71 is configured to acquire an original signal input timing. Converting the original signal input timing into an arranged signal input timing according to the pixel unit 75 arranged in a predetermined rule, acquiring first grayscale data and second grayscale data according to the arranged signal input timing, and outputting the first grayscale data and the second grayscale data to the data driving unit 72;

the data driving unit 72 is configured to generate a first grayscale driving voltage according to the first grayscale data, and generate a second grayscale driving voltage according to the second grayscale data; and loading the first grayscale driving voltage or the second grayscale driving voltage into the pixel matrix along a direction of each data line within a frame;

the scan driving unit 73 is used to turn on each scanning line.

In a specific embodiment, the pixel unit 75 arranged in a predetermined rule includes: a first sub-pixel having a first color filter; a second sub-pixel having a second color filter adjacent to the first sub-pixel in a first direction; a third sub-pixel having a third color filter adjacent to the second sub-pixel in a first direction; a fourth sub-pixel having a third color filter adjacent to the first sub-pixel in a second direction; a fifth sub-pixel having a first color filter adjacent to the fourth sub-pixel in a first direction; a sixth sub-pixel having a second color filter adjacent to the fifth sub-pixel in a first direction; a seventh sub-pixel having a second color filter adjacent to the fourth sub-pixel in a second direction; an eighth sub-pixel having a third color filter adjacent to the seventh sub-pixel in a first direction; and a ninth sub-pixel having a first color filter adjacent to the eighth sub-pixel in the first direction.

In a specific embodiment, the sub-pixel has an aspect ratio of 1.5:2.

In a specific implementation, the timing controller 71 is specifically configured to acquire original pixel data of each pixel position according to the signal input timing of the arrangement. The original pixel data of each pixel position is converted into the first grayscale data or the second grayscale data in accordance with a predetermined conversion manner.

In summary, the low color shift pixel matrix display device of the embodiment. Through the pixel matrix architecture with the driving method design, the penetration rate is enhanced in the UD panel design, and the pixel charging time is improved, the display quality is enhanced, and the user experience is improved.

Embodiment 5

Figure 11:
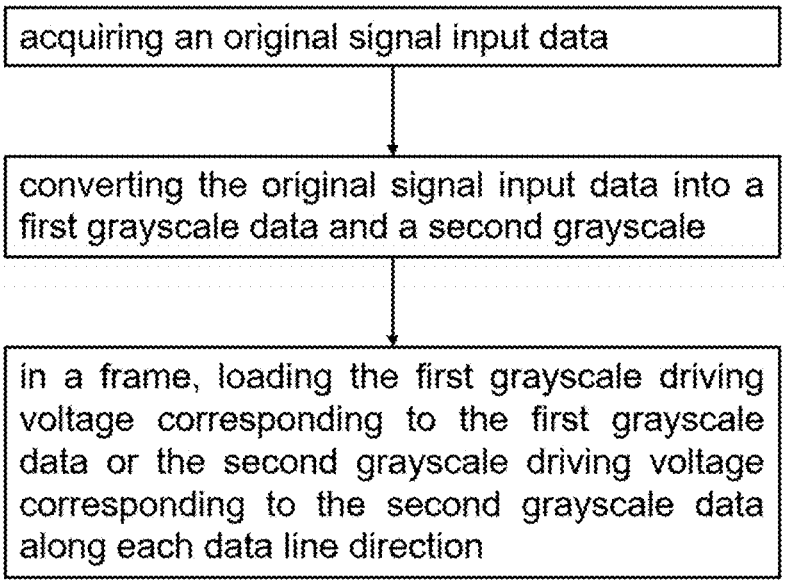
FIG. 11 is a flowchart of a pixel matrix display method according to a fifth embodiment of the present invention.

Referring to FIG. 11, FIG. 11 is a flowchart of a pixel matrix display method according to a fifth embodiment of the present invention, which can be applied to display driving of a display panel of various electronic devices. The pixel matrix of the display panel includes a plurality of sub-pixels arranged in a matrix, and the pixel matrix display method includes the following steps:

acquiring raw signal input data;

converting the original signal input data into first grayscale data and second grayscale data; and loading, in a frame, a first grayscale driving voltage corresponding to the first grayscale data or a second grayscale driving voltage corresponding to the second grayscale data to the pixel matrix along a direction of each data line;

wherein, the sub-pixel aspect ratio a/b satisfies the relationship: $0.675 \leq a/b \leq 1.48$.

The display method of this embodiment can be applied to display devices of various resolution requirements, but is mainly applied to high-resolution display, such as high-resolution display devices such as 4K and 8K. For example, the resolution requirement of 8K4K is 7680×4320, that is, the resolution requirement in the X direction is 7680, and the resolution requirement in the Y direction is 4320.

Figure 12:
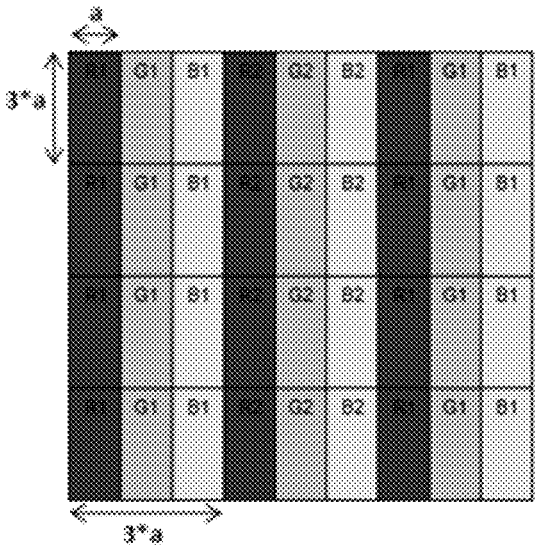
FIG. 12 is a schematic diagram showing the ratio and arrangement of existing pixel designs.

Taking a traditional RGB pixel matrix as an example, please refer to FIG. 12, which is a schematic diagram of the ratio and arrangement of existing pixel designs. A sub-pixel has an aspect ratio of 1:3, and a complete pixel consists of three sequentially arranged RGB sub-pixels. Therefore, if the 7680 resolution is required in the X direction, the number of pixels required is 7680×3, and it is 4320×1 in the Y direction.

Figure 13:
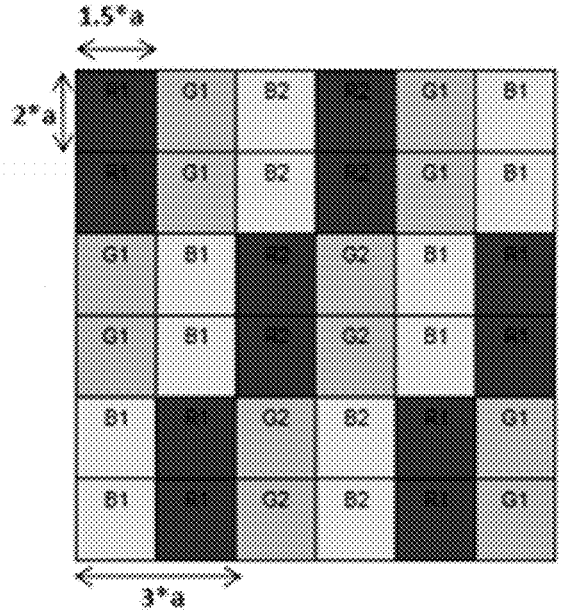
FIG. 13 is a schematic diagram showing a pixel design ratio and arrangement according to a fifth embodiment of the present invention.

For the pixel matrix of the embodiment, please refer to FIG. 13, which is a schematic diagram of the pixel design ratio and arrangement of the embodiment. This embodiment improves the display quality by increasing the length of the sub-pixel and correspondingly reducing the width of the sub-pixel. In this embodiment, the aspect ratio of one sub-pixel is 3:4. Specifically, if the conventional sub-pixel has a length of a, and a width of 3a, the sub-pixel of the embodiment has a length of 1.5a and a width of 2a.

Since the scheme of the embodiment changes the size of the sub-pixel, if the 7680 resolution is required in the X direction, the number of pixels required is 7680×2, and 4320×1.5 in the Y direction. In order to better implement the embodiment, it is necessary to change the driving manner of the pixel matrix and the driving architecture. Therefore, this embodiment uses a pixel sharing method to achieve the same resolution design. Under the same 8K4K resolution, the number of pixels in the X direction is: 7680×2 in the present embodiment, and the number of pixels in the Y direction is: 4320×1.5, and the design of the present embodiment is completed by using 2 pixel sharing 3 sub-pixels manner in the Y direction.

Specifically, one data line is connected to each side of each column of sub-pixels, and one scanning line is connected between every two rows of sub-pixels. For example, if R11, G11, B11 are adjacent sub-pixels in a row, and R11 is a starting pixel; R11, R21, G31, G41 are adjacent sub-pixels in a column, and R11 is a starting pixel; then, a data line D1 is arranged on the left side of R11, two data lines D2 and D3 are arranged between R11 and G11, two data lines D4 and D5 are arranged between G11 and B11, and so on. A scanning line G1 is arranged on the upper side of R11, there is no scanning line between R11 and R21, a scanning line G2 is arranged between R21 and G31, there is no scanning line between G31 and G41, and so on, and vice versa. In terms of architecture, the data line polarity is column inversion. Because each column of sub-pixels is connected with one data line on each side, the corresponding data lines respectively carry odd-row sub-pixels and even-row sub-pixels in one column of sub-pixels, so that the polarity of the sub-pixels of any column is alternately reversed. In addition, since one scanning line is connected between every two rows of sub-pixels, each scanning line carries the input of the scanning signal of the sub-pixels on both sides thereof.

Figure 14:
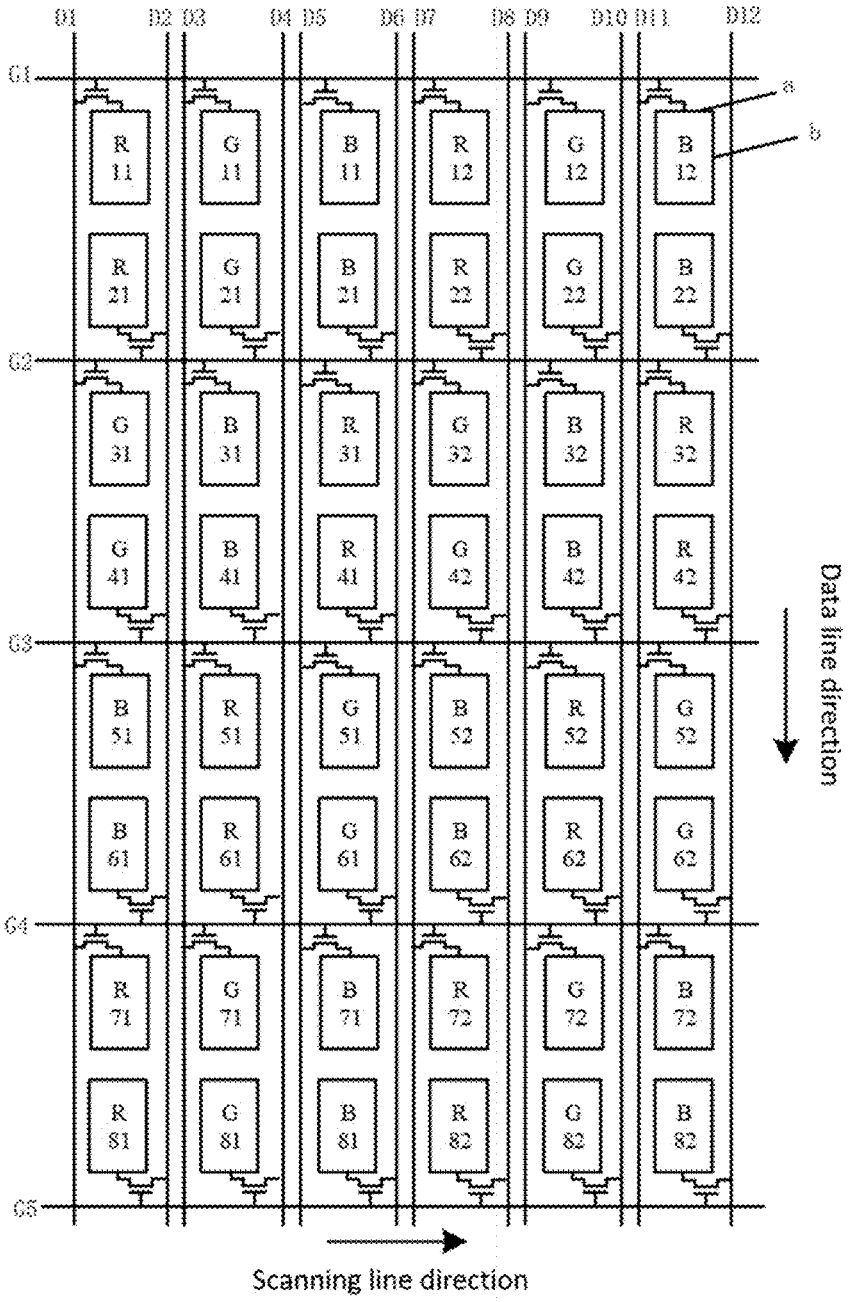
FIG. 14 is a schematic diagram of a pixel matrix structure according to a fifth embodiment of the present invention.

For a better description of the driving architecture and the driving manner of the embodiment, please refer to FIG. 14, which is a schematic diagram of a pixel matrix structure provided by the embodiment. R11-B12 is 6 adjacent sub-pixels in a certain row, and R11-R81 are 8 sub-pixels adjacent to a certain column, where R represents a red sub-pixel, G represents a green sub-pixel, and B represents a blue sub-pixel. The minimum pixel unit in this embodiment is composed of 3×6=18 sub-pixels, for example, 18 sub-pixels of R11, G11, B11, R21, G21, B21, G31, B31, R31, G41, B41, R41, B51, R51, G51, B61 and R61 constitute one pixel unit.

Wherein the data line D1 is connected to the sub-pixel R11, the sub-pixel G31, the sub-pixel B51, and the sub-pixel R71, the data line D2 is connected to the sub-pixel R21, the sub-pixel G41, the sub-pixel B61, and the sub-pixel R81, and the data line D3 is connected to the sub-pixel G11, the sub-pixel B31, the sub-pixel R51, and the sub-pixel G71, the data line D4 is connected to the sub-pixel G21, the sub-pixel B41, the sub-pixel R61, and the sub-pixel G81, and the data line D5 is connected to the sub-pixel B11, the sub-pixel R31, the sub-pixel G51, and the sub-pixel B71, the data line D6 is connected to the sub-pixel B21, the sub-pixel R41, the sub-pixel G61, the sub-pixel B81, and the data lines D7, D8, and so on; the scanning line G1 is connected to the sub-pixel R11, the sub-pixel G11, and the sub-pixel B11, and the scanning line G2 is connected to the sub-pixel R21, the sub-pixel G21, the sub-pixel B21, the sub-pixel G31, the sub-pixel B31, and the sub-pixel R31, the scanning line G3 is connected to the sub-pixel G41, the sub-pixel B41, the sub-pixel R41, the sub-pixel B51, the sub-pixel R51, and the sub-pixel G51, the scanning line G4 is connected to the sub-pixel B61, the sub-pixel R61, the sub-pixel G61, the sub-pixel R71, the sub-pixel G71, the sub-pixel B71, and the scanning lines G5, G6, and so on.

In the driving sequence, the scanning line G1 is turned on at the first timing of a certain frame, and the data line D1, the data line D3, and the data line D5 are charged with a positive polarity voltage to the sub-pixel R11, the sub-pixel G11, and the sub-pixel B11, respectively.

At the second moment of the frame, the scanning line G2 is turned on, the data line D1, the data line D3, and the data line D5 are charged with a positive polarity voltage to the sub-pixel G31, the sub-pixel B31, and the sub-pixel R31, respectively. The data line D2, the data line D4, and the data line D6 are respectively charged with a negative polarity voltage to the sub-pixel R21, the sub-pixel G21, and the sub-pixel B21.

At the third moment of the frame, the scanning line G3 is turned on, the data line D1, the data line D3, and the data line D5 are charged with a positive polarity voltage to the sub-pixel B51, the sub-pixel R51, and the sub-pixel G51, respectively. The data line D2, the data line D4, and the data line D6 are respectively charged with a negative polarity voltage to the sub-pixel G41, the sub-pixel B41, and the sub-pixel R41.

At the fourth moment of the frame, the scanning line G4 is turned on, the data line D1, the data line D3, and the data line D5 are charged with a positive polarity voltage to the sub-pixel R71, the sub-pixel G71, and the sub-pixel B71, respectively. The data line D2, the data line D4, and the data line D6 are respectively charged with a negative polarity voltage to the sub-pixel B61, the sub-pixel R61, and the sub-pixel G61.

Taking 8K4K as an example, the number of scanning lines is 3241. At the 5th to 3240th time of the frame, the scanning lines G5-G3240 are correspondingly turned on, and the sub-pixels are charged according to the above charging principle. And when the last scanning line G3241 is turned on, the data line D2, the data line D4, and the data line D6 are respectively charged with a negative polarity voltage to the sub-pixel B64801, the sub-pixel R64801, and the sub-pixel G64801; one frame is completed, and the data line polarity is reversed in the next frame, and the next frame sub-pixel charging is continued according to the above principle.

According to the above, in the existing design, the number of pixels in the Y direction is 4320×1=4320, and the number of scanning lines corresponds to 4320 pixels in the Y direction. Taking the scanning frequency of 60 Hz as an example, the charging time of each corresponding sub-pixel is about 3.86 μs.

For the design of this embodiment, please refer to Table 1. The number of pixels in the Y direction is 4320×1.5=6480, and according to the architecture of the embodiment, the number of scanning lines is 6480/2=3240. Since the total scan time of one frame is fixed, the same scanning time requires 4320 times in the prior art, and the solution of this embodiment only needs 3240 times. The corresponding charging time of each sub-pixel is also extended accordingly, which is about 5.14 μs, thus increasing the charging time of a single pixel, enhancing the display quality and improving the user experience.

TABLE 1

| | Resolution | | Pixel composition | | Number of pixels | |
|---|---|---|---|---|---|---|
| | X | Y | X | Y | X | Y |
| Traditional design | 7680 | 4320 | 3 | 1 | 7680*3 | 4320*1 |
| Embodiment design | 7680 | 4320 | 2 | 1.5 | 7680*2 | 4320*1.5 |

The pixel matrix display method of the embodiment of the invention is designed by a pixel matrix structure and a driving method. In the design of panels with high resolution requirements such as 8K4K, the coupling effect of the data lines on the sub-pixel voltage is greatly reduced, and the aperture ratio is increased, which in turn increases the transmittance. At the same time, the pixel charging time is improved, the display quality is enhanced, and the user experience is improved.

Embodiment 6

In a specific embodiment, in addition to the content of the fifth embodiment, the embodiment further includes: loading the first grayscale driving voltage or the second grayscale driving voltage alternately every three sub-pixels along each scanning line direction; alternately loading the first grayscale driving voltage or the second grayscale driving voltage to each sub-pixel along each data line direction.

In a specific example, the first grayscale driving voltage is, for example, a high grayscale voltage (voltage level of H), and the second grayscale driving power is, for example, a low grayscale voltage (voltage level of L). Correspondingly, the magnitude of the voltage input to the sub-pixel is determined by the grayscale. It is worth mentioning that the high grayscale and the low grayscale represent the relative values of the grayscale sizes of the two groups, and the magnitude of the value is not separately limited. For example, it can be considered that if the original potential is maintained at H, the original potential is lowered to L, or the original potential is maintained at L, and the original potential is raised to H.

For example, the original pixel value (original pixel data) of a certain location is a 128 grayscale, and according to the above rule of the embodiment, the position should output a high grayscale voltage, that is, H. After calculation, in this example, H=138 grayscale, then output the 138 grayscale, the data driving unit receives the 138 grayscale. According to the established conversion rule, the voltage corresponding to the 138 grayscale is 10V, and finally the voltage signal of 10V is output to the A position. Generally, the adjustment range of the high and low grayscale is determined by the difference of materials such as liquid crystal.

For another example, the original pixel value of a location is a 128 grayscale. If the above rule is used according to the present invention, the location should output a low grayscale, that is, L. After calculation, in this example, L=118 grayscale, then output the 118 grayscale to the B position, the data driving unit receives the 118 grayscale. According to the established conversion rules, the voltage corresponding to the grayscale of 118 is 8V, and finally the voltage signal of 8V is output to the B position.

Figure 15:
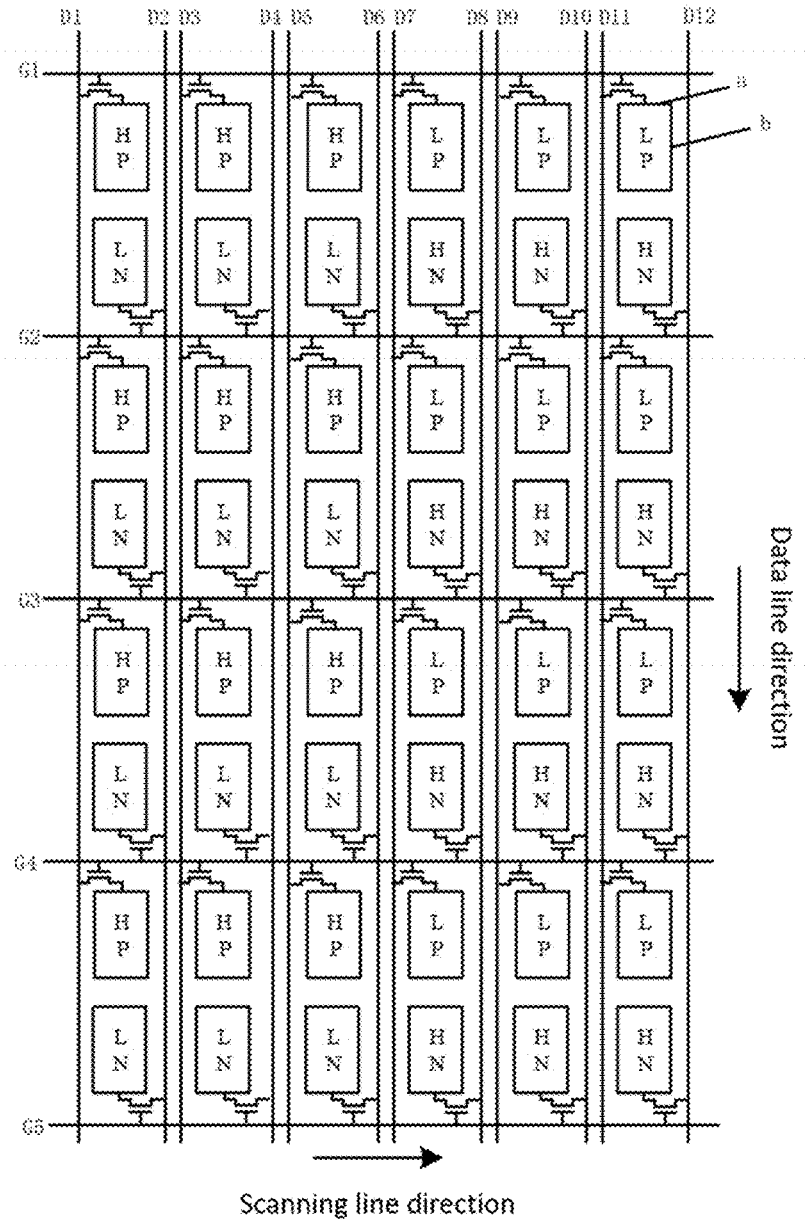
FIG. 15 is a schematic diagram of driving a pixel matrix according to a sixth embodiment of the present invention.

Referring to FIG. 15, FIG. 15 is a schematic diagram of a pixel matrix driving according to a sixth embodiment of the present invention. Referring to the driving rule in the fifth embodiment, loading of potential and polarity is performed. Where P indicates that the voltage applied by the sub-pixel is a positive voltage, and N indicates that the voltage applied by the sub-pixel is a negative voltage, H indicates that the voltage grayscale of the sub-pixel loading is a high grayscale, and L indicates that the voltage grayscale of the sub-pixel loading is a low grayscale.

In the driving sequence, at the first moment of a certain frame, the scanning line G1 is turned on, the data line D1, the data line D3, and the data line D5 respectively charge the positive pixel voltage high grayscale voltage (HP) to the sub-pixel R11, the sub-pixel G11, and the sub-pixel B11, the data line D7, the data line D9, and the data line D11 are charged with a positive polarity low grayscale voltage (LP) for the sub-pixel R12, the sub-pixel G12, and the sub-pixel B12, respectively.

At the second moment of the frame, the scanning line G2 is turned on, the data line D1, the data line D3, and the data line D5 respectively charge the positive pixel voltage high grayscale voltage (HP) to the sub-pixel G31, the sub-pixel B31, and the sub-pixel R31, the data line D7, the data line D9, and the data line D11 are respectively charged with a positive polarity low grayscale voltage (LP) for the sub-pixel G32, the sub-pixel B32, and the sub-pixel R32; the data line D2, the data line D4, and the data line D6 are respectively charged with a negative low-gradation voltage (LN) for the sub-pixel R21, the sub-pixel G21, and the sub-pixel B21, the data line D8, the data line D10, and the data line D12 respectively charge the sub-pixel R22, the sub-pixel G22, and the sub-pixel B22 with a negative low-order voltage (HN).

At the third moment of the frame, the scanning line G3 is turned on, the data line D1, the data line D3, and the data line D5 are respectively charged with a positive high-gradation voltage (HP) for the sub-pixel B51, the sub-pixel R51, and the sub-pixel G51, the data line D7, the data line D9, and the data line D11 are respectively charged with a positive low-gradation voltage (LP) for the sub-pixel B52, the sub-pixel R52, and the sub-pixel G52, the data line D2, the data line D4, and the data line D6 are charged with a negative polarity low voltage (LN) for the sub-pixel G41, the sub-pixel B41, and the sub-pixel R41, respectively, the data line D8, the data line D10, and the data line D12 are respectively charged with a negative polarity high voltage (HN) for the sub-pixel G42, the sub-pixel B42, and the sub-pixel R42.

At the fourth moment of the frame, the scanning line G4 is turned on, the data line D1, the data line D3, and the data line D5 respectively charge the positive pixel high grayscale voltage (HP) to the sub-pixel R71, the sub-pixel G71, and the sub-pixel B71, the data line D7, the data line D9, and the data line D11 are charged with a positive low-gradation voltage (LP) for the sub-pixel R72, the sub-pixel G72, and the sub-pixel B72, respectively, the data line D2, the data line D4, and the data line D6 respectively charge the sub-pixel B61, the sub-pixel R61, and the sub-pixel G61 with a negative low-gradation voltage (LN), the data line D8, the data line D10, and the data line D12 respectively charge the sub-pixel B62, the sub-pixel R62, and the sub-pixel G62 with a negative high-gradation voltage (HN); and so on. After one frame is completed, the data line polarity is reversed in the next frame, and the next frame sub-pixel charging is continued according to the above principle. Achieve the 8-Domain display.

Figure 16:
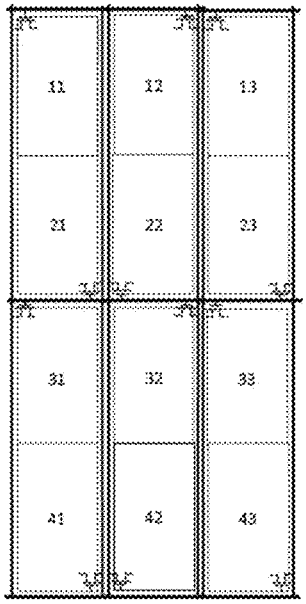
FIG. 16 is a schematic diagram of a pixel matrix structure according to another embodiment of the present invention.
Figure 17:
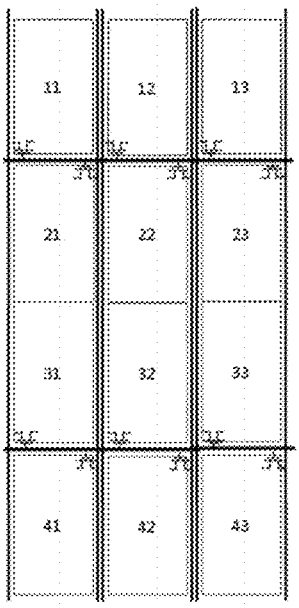
FIG. 17 is a schematic diagram of another pixel matrix architecture according to another embodiment of the present invention.
Figure 18:
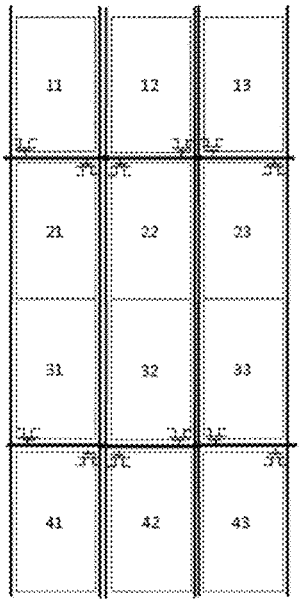
FIG. 18 is a schematic diagram of still another pixel matrix structure according to another embodiment of the present invention.

Based on the architecture and the driving manners, please refer to FIG. 16 to FIG. 18. FIG. 16 to FIG. 18 also provide three other architectural modes. The specific driving manners may be driven by referring to the sixth embodiment, and details are not described herein again.

The pixel matrix display method of the embodiment of the invention is designed by the pixel matrix structure and the driving mode, so that the coupling effect of the data line on the sub-pixel voltage is greatly reduced in the design of the panel with high resolution requirements such as 8K4K. And the aperture ratio is increased, and the penetration rate is improved, and the pixel charging time is improved, the display quality is enhanced, and the user experience is improved.

Embodiment 7

In a specific embodiment, the sub-pixels have an aspect ratio of 1.5:2. This design can reduce the coupling effect of the data line on the pixel voltage and improve the aperture ratio design of the pixel.

Figure 19:
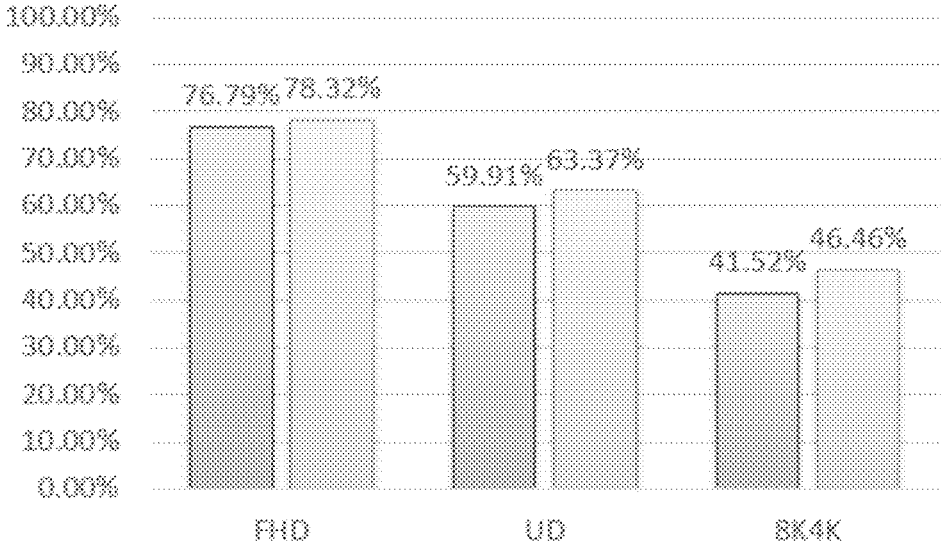
FIG. 19 is a graph showing the difference in aperture ratio design using the existing design and the present embodiment under different resolution specifications for the seventh product of the seventh embodiment of the invention.

Compared with the existing design, the solution of this embodiment has a positive effect on the improvement of the aperture ratio, please refer to FIG. 19. FIG. 19 is a graph showing the difference in aperture ratio design using the existing design (Normal) and the present embodiment under different resolution specifications in the same product size in this example. Under the same design conditions, the aperture ratio of this embodiment is about 2 to 5% higher than that of the conventional design, and the higher the resolution, the greater the increase of the aperture ratio.

Figure 20:
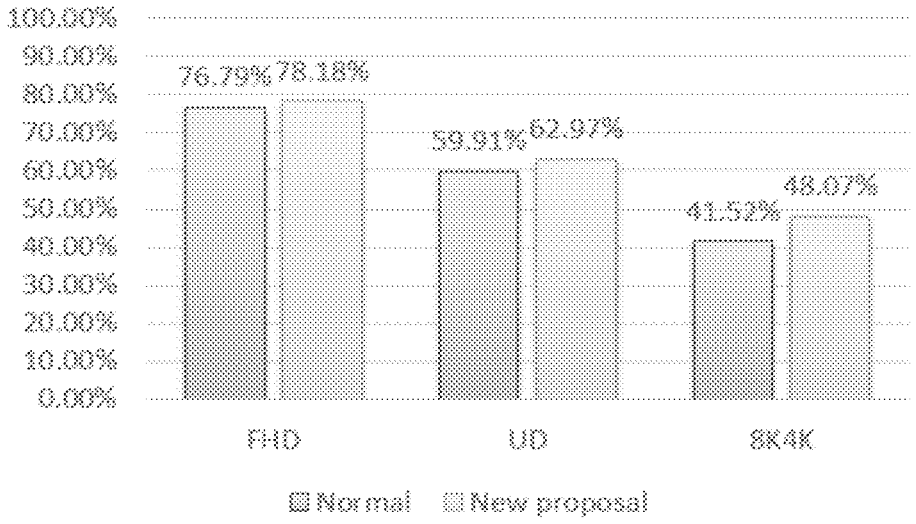
FIG. 20 is a graph showing the difference in aperture ratio design using the existing design and the present embodiment under different resolution specifications for other embodiments of the invention.

In another specific embodiment, the sub-pixels have an aspect ratio of 2/1.5. This design can reduce the coupling effect of the data line on the pixel voltage and improve the aperture ratio design of the pixel. Compared with the existing design, the solution of this embodiment has a positive effect on the improvement of the aperture ratio, please refer to FIG. 20. FIG. 20 is a graph showing the difference in aperture ratio design using the existing design (Normal) and the present embodiment under different resolution specifications in the same product size in this example. Under the same design conditions, the aperture ratio of this embodiment is about 1.5 to 6.5% higher than that of the conventional design, and the higher the resolution, the greater the increase of the aperture ratio.

In the embodiment of the present invention, the display quality is improved by increasing the length of the sub-pixel and correspondingly reducing the width of the sub-pixel. In the above example, the aspect ratio of one sub-pixel is 4:3. Specifically, if the conventional sub-pixel has a length of a, and a width of 3a, the sub-pixel of the embodiment has a length of 2a and a width of 1.5a.

Since the scheme of the present embodiment changes the size of the sub-pixel, if the 7680 resolution is required in the X direction, the number of pixels required is 7680×1.5, and 4320×2 in the Y direction. In order to better implement the embodiment, it is necessary to change the driving manner of the pixel matrix and the driving architecture. Therefore, this embodiment uses a pixel sharing method to achieve the same resolution design. In the same 8K4K resolution, the number of pixels in the X direction of the embodiment is: 7680×1.5, and the number of pixels in the Y direction is: 4320×2. The scheme of this embodiment is completed by using a design in which two pixels are used in a total of three sub-pixels in the X direction. In the existing design, the number of pixels in the Y direction is 4320×1=4320, and the number of scanning lines corresponds to 4320 pixels in the Y direction. Taking the scanning frequency as 60 Hz as an example, the corresponding charging time of each sub-pixel is 3.86 μs.

In the design of the embodiment, referring to Table 2, the number of pixels in the Y direction is 4320×2=8640, and according to the architecture of the embodiment, the number of scanning lines is 8640/2=4320. Since the total scan time of one frame is fixed, the same scanning time requires 4320 times in the prior art, and the number of pixels in the Y direction is doubled. However, with the design of a scanning line shared by two pixels in the Y direction, the number of pixels in the Y direction is increased, but the charging time of the pixel can be maintained to enhance the display quality as with the conventional design. However, for the X direction, since the number of pixels in the X direction is reduced by 50% relative to the prior art, the user experience is improved.

TABLE 2

| | Resolution | | Pixel composition | | Number of pixels | |
|---|---|---|---|---|---|---|
| | X | Y | X | Y | X | Y |
| Traditional design | 7680 | 4320 | 3 | 1 | 7680*3 | 4320*1 |
| Embodiment design | 3840 | 8640 | 3 | 1 | 3840*3 | 8640 |
| | 7680 | 4320 | 1.5 | 2 | 7680*1.5 | 4320*2 |

The pixel matrix display method of the embodiment of the present invention, by designing the pixel matrix structure and the driving mode, makes the coupling effect of the data line on the sub-pixel voltage greatly reduced in designing a panel with high resolution requirements such as 8K4K. And the aperture ratio is increased, and the penetration rate is improved, and the pixel charging time is improved, the display quality is enhanced, and the user experience is improved.

Embodiment 8

The present embodiment includes the contents of the foregoing fifth to seventh embodiments, and further includes using an ITO common electrode material, wherein the opening area width of the sub-pixel is S=X−2×D−G, where X is the sub-pixel length, D is the data line width, and G is the two data line spacing between adjacent sub-pixels.

In the conventional 1D pixel design, in order to reduce the coupling effect of the data line on the pixel electrode, a common electrode is designed between the data line and the pixel electrode to improve the above problem, but using this design causes a decrease in the aperture ratio of the pixel. When the resolution is higher, the pixel size is getting smaller and smaller, and the decrease amplitude of the pixel aperture ratio is more pronounced.

Figure 21:
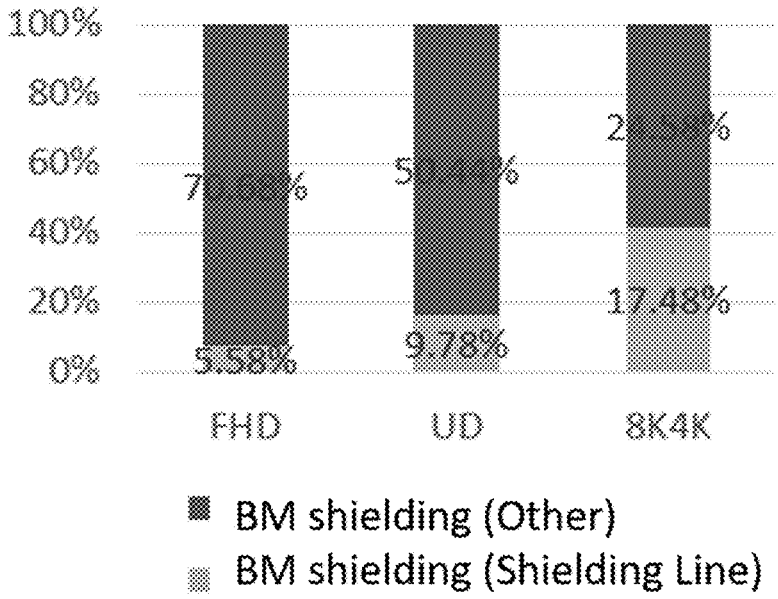
FIG. 21 is a graph showing the effect of the prior art common electrode design on the aperture ratio at different resolutions.

FIG. 21 shows the effect of the above common-electrode design on the pixel aperture ratio for simulating the FHD, UD, and 8K4K resolution specifications for a certain size product. In the FHD resolution specification, the ratio of the common electrode design space to the aperture ratio is only about 7%; but to the UD resolution specification, the ratio of the common electrode design space to the aperture ratio has increased to 16%. Even at the 8K4K resolution specification, the ratio of the common electrode design space to the aperture ratio has increased to 41%.

In this embodiment, the conventional design method of using metal as a common electrode is changed to use ITO as a common electrode design, and there is no loss of aperture ratio caused by the conventionally designed common electrode design.

The width of the open area in the X direction only considers the design width of the data line; in theory, the width of the open area=X−D (μm).

Since the design of the embodiment using the ITO overlay on the data line causes some signal distortion to the data line, the present embodiment is combined with a COA (Color-on Array) process to reduce the data line load.

In the COA+ITO process of the present embodiment, the TFT side has an 8-layer structure, the first layer is a common electrode layer, the second layer is a semiconductor protective layer, the third layer is a source electrode, the fourth and fifth layers are protective layers for the coating process, the sixth layer is the ITO common electrode, the seventh layer is the protective layer, and the eighth layer is the ITO pixel electrode.

For a sub-pixel combination with a ratio of 1.5:2, the pixel electrode can be directly overlaid on the data line by using a COA (Color on Array) process. Therefore, the original metal common electrode design can be removed, the aperture ratio can be further improved, and the COA process can simultaneously improve the data line distortion problem.

The width of the open area in the X direction only considers the design width and spacing of the data lines. The opening area width of the sub-pixel is S=X−2×D−G, where X is the sub-pixel length, D is the data line width, and G is the two data line spacing between adjacent sub-pixels.

Compared with the conventional design and the COA process, the present embodiment can obtain a higher aperture ratio increase, and the higher the resolution, the higher the pixel aperture ratio is increased. When the product resolution is FHD, the proposed design increases the aperture ratio by about 7% compared with the traditional design; when the product is UD resolution, the proposed design can increase the opening ratio by about 18.4% compared with the traditional design; when it reaches the 8K4K resolution specification, the improvement can be as high as 45.3%.

For a sub-pixel combination with a ratio of 2/1.5, the pixel electrode can directly cover the data line by using the COA (Color on Array) process. Therefore, the original metal common electrode design can be removed, the aperture ratio can be further improved, and the COA process can simultaneously improve the data line distortion problem.

The width of the open area in the X direction only considers the design width and spacing of the data lines. The opening area width of the sub-pixel is S=X−2×D−G, where X is the sub-pixel length, D is the data line width, and G is the two data line spacing between adjacent sub-pixels.

Compared with the conventional design and the COA process, the present embodiment can obtain a higher aperture ratio increase, and the higher the resolution, the higher the pixel aperture ratio is increased. When the product resolution is FHD, the proposed design increases the aperture ratio by about 6% compared with the traditional design; when the product is UD resolution, the proposed design can increase the opening rate by about 13.7% compared with the traditional design; when it reaches the 8K4K resolution specification, the improvement can be as high as 37%.

Embodiment 9

Figure 22:
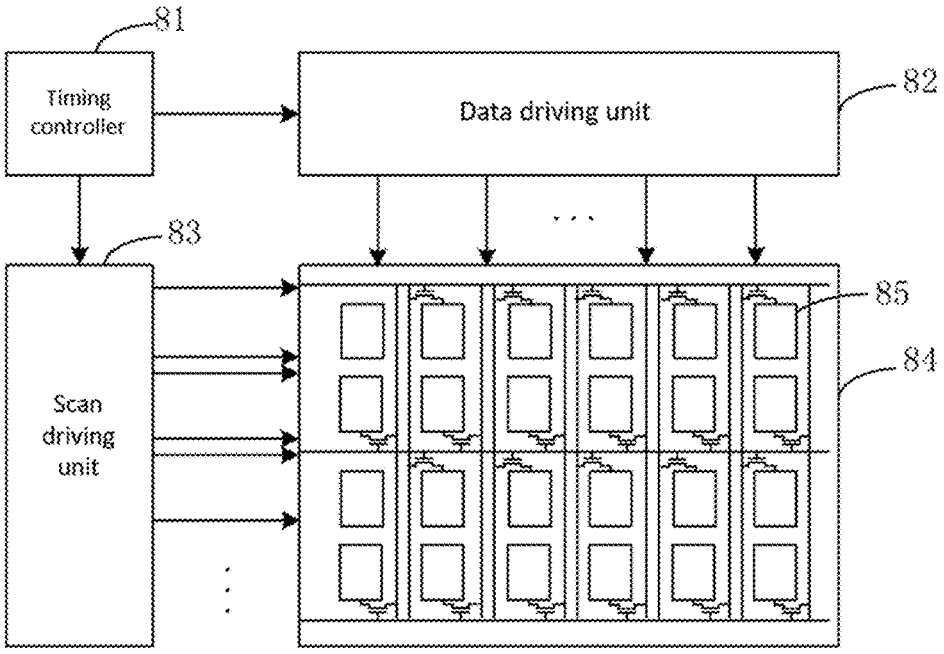
FIG. 22 is a schematic diagram of a pixel matrix display device according to a ninth embodiment of the present invention.

Referring to FIG. 22, FIG. 22 is a schematic diagram of another pixel matrix display device according to an embodiment of the present invention, including a timing controller 81, a data driving unit 82, a scan driving unit 83, and a pixel matrix 84. The pixel matrix 84 includes a plurality of sub-pixels 85 arranged in a matrix.

The timing controller 81 is configured to acquire original signal input data, and convert the original signal input data into first grayscale data and second grayscale data.

The scan driving unit 82 is configured to load a scan signal to the pixel matrix 84.

And in a frame, the data driving unit 82 is configured to load the first grayscale driving voltage corresponding to the first grayscale data or the second grayscale driving voltage corresponding to the second grayscale data to the pixel matrix 84 along each data line direction.

Wherein, the sub-pixel aspect ratio a/b satisfies the relationship: $0.675 \le a/b \le 1.48$.

In a specific embodiment, the data driving unit 82 is further configured to control the data line polarity column inversion. And the scan driving unit 83 is for controlling the input of the scan signal of each of the scanning lines carrying the sub-pixels 85 on both sides thereof.

In a specific embodiment, the data driving unit 82 is further configured to alternately load the first grayscale driving voltage or the second grayscale driving voltage into every three subpixels along each scanning line direction; the first grayscale driving voltage or the second grayscale driving voltage is alternately loaded to each of the sub-pixels 85 along each data line direction.

In a specific embodiment, the sub-pixel 85 has an aspect ratio of 1.5:2.

In another embodiment, the sub-pixel 85 has an aspect ratio of 2/1.5.

In a specific embodiment, the width of the open area of the sub-pixel 85 is S=X−2×D−G, where X is the sub-pixel length, D is the data line width, and G is the two data line spacing between adjacent sub-pixels 85.

The pixel matrix display device of the embodiment of the present invention, by designing the pixel matrix structure and the driving method, makes the coupling effect of the data line on the sub-pixel voltage greatly reduced in designing a panel with high resolution requirements such as 8K4K. And the aperture ratio is increased, and the penetration rate is improved, and the pixel charging time is improved, the display quality is enhanced, and the user experience is improved.

Moreover, it will be understood that the foregoing various embodiments are merely illustrative of the invention. The technical solutions of the various embodiments may be used in any combination and in combination in the case that the technical features are not conflicting, the structure is not contradictory, and the object of the invention is not violated.

In addition, it can be seen from the related drawings of the foregoing embodiments that, in the device proposed by the embodiment of the present invention, different color sub-pixels are driven by different data lines and scanning lines. For example, in the example of FIG. 4 in the embodiment of the present invention, the RGB design is a pen-tile arrangement, so that for the same data line, sub-pixels of different colors are charged at different scanning line positions.

Finally, it should be noted that the above embodiments are only used to illustrate the technical solutions of the present invention and are not limited thereto. Although the present invention has been described in detail with reference to the foregoing embodiments, those skilled in the art should understand that the technical solutions described in the foregoing embodiments may be modified or equivalently substituted for some of the technical features. The modifications and substitutions of the present invention do not depart from the spirit and scope of the technical solutions of the embodiments of the present invention.

What is claimed is:

1. A pixel matrix display device comprising a timing controller, a data driving unit, a scan driving unit, and a pixel matrix, wherein the pixel matrix comprises a plurality of pixel units arranged in a predetermined regular manner; the timing controller is configured to acquire an original signal input timing, and convert the original signal input timing into an arranged signal input timing according to the pixel unit arranged in a predetermined manner, and within a frame, drive the data driving unit and the scan driving unit to load a corresponding data driving voltage and a corresponding scan driving voltage to the pixel matrix according to the arranged signal input timing;

wherein the pixel unit arranged in the predetermined manner comprises:

a first sub-pixel having a first color filter;

a second sub-pixel having a second color filter disposed on a right side of the first sub-pixel;

a third sub-pixel having a third color filter disposed below the first sub-pixel;

a fourth sub-pixel having the first color filter disposed on a right side of the third sub-pixel;

a fifth sub-pixel having the second color filter disposed below the third sub-pixel; and a sixth sub-pixel having the third color filter disposed below the fourth sub-pixel;

wherein the data driving unit and the scan driving unit are configured to:

load a corresponding data driving voltage and a corresponding scan driving voltage to the first sub-pixel and the second sub-pixel at a first moment;

load the corresponding data driving voltage and the corresponding scan driving voltage to the third sub-pixel and the fourth sub-pixel at a second moment; and load the corresponding data driving voltage and the corresponding scan driving voltage to the fifth sub-pixel and the sixth sub-pixel at a third moment.

2. The pixel matrix display device according to claim 1, wherein an aspect ratio of the sub-pixel is 1.5:2.

3. The pixel matrix display device according to claim 1, wherein the timing controller is configured to: acquire a first grayscale data and a second grayscale data according to the arranged signal input timing, and output the first grayscale data and the second grayscale data to the data driving unit; and the data driving unit is configured to generate a first grayscale driving voltage according to the first grayscale data, generate a second grayscale driving voltage according to the second grayscale data, and within a frame, load the first grayscale driving voltage or the second grayscale driving voltage into the pixel matrix along a direction of each data line.

4. The pixel matrix display device according to claim 3, wherein the timing controller is configured to: acquire an original pixel data of each pixel position according to the arranged signal input timing and convert the original pixel data of each pixel position into the first grayscale data or the second grayscale data in accordance with a predetermined conversion manner.

* * * * *